US007481012B1

(12) United States Patent
Servoss

(10) Patent No.: US 7,481,012 B1
(45) Date of Patent: Jan. 27, 2009

(54) PERPETUAL CALENDAR SYSTEM AND METHOD OF USE THEREOF

(76) Inventor: William Carr Servoss, 2312 S. 2300 East, Salt Lake City, UT (US) 84109

( * ) Notice: Subject to any disclaimer, the term of this patent is extended or adjusted under 35 U.S.C. 154(b) by 46 days.

(21) Appl. No.: 11/599,793

(22) Filed: Nov. 15, 2006

(51) Int. Cl.
*G09D 3/10* (2006.01)

(52) U.S. Cl. ..... 40/109; 40/118

(58) Field of Classification Search ..... 40/107, 40/109, 118, 491, 492, 495; 283/2
See application file for complete search history.

(56) References Cited

U.S. PATENT DOCUMENTS

| | | | | | |
|---|---|---|---|---|---|
| 465,294 | A | * | 12/1891 | Ross | 40/109 |
| 1,066,642 | A | * | 7/1913 | Mohlin | 40/109 |
| 1,250,882 | A | * | 12/1917 | House | 40/109 |
| 1,328,830 | A | * | 1/1920 | Friedman | 40/109 |
| 1,353,751 | A | * | 9/1920 | Hutson | 40/109 |
| 1,493,378 | A | * | 5/1924 | Patterson | 40/109 |
| 1,541,151 | A | * | 6/1925 | Khalifah | 40/109 |
| 1,558,020 | A | * | 10/1925 | Lauer | 40/109 |
| 1,661,110 | A | * | 2/1928 | Cox | 40/109 |
| 2,575,555 | A | * | 11/1951 | La Plante | 40/109 |
| 3,201,884 | A | * | 8/1965 | Aughey | 40/109 |
| 3,427,740 | A | * | 2/1969 | Heskes | 40/109 |
| 3,605,307 | A | * | 9/1971 | Dickson | 40/109 |
| 3,694,943 | A | | 10/1972 | De Filippo | |
| 3,755,941 | A | * | 9/1973 | Zeiske | 40/109 |
| 3,800,454 | A | | 4/1974 | Anderson | |
| 3,936,966 | A | | 2/1976 | Zeiske | |
| 4,285,147 | A | | 8/1981 | Kolar | |
| 4,418,274 | A | | 11/1983 | Masillo | |
| 4,484,402 | A | | 11/1984 | Kebe | |
| 5,222,052 | A | | 6/1993 | Salame | |
| 5,313,723 | A | | 5/1994 | Cregg | |
| 5,657,561 | A | | 8/1997 | Zykov | |
| 5,930,924 | A | | 8/1999 | Beard | |
| 6,280,200 | B1 | | 8/2001 | Cunningham | |
| 6,877,262 | B2 | | 4/2005 | Bianco | |
| 7,140,132 | B2 | | 11/2006 | Barton | |

* cited by examiner

*Primary Examiner*—Gary C Hoge
(74) *Attorney, Agent, or Firm*—Jones Waldo Holbrook & McDonough

(57) ABSTRACT

A calendar system comprising a user interface having: a century table; a weekday table; an optional first lever channel; and an optional second lever channel. The system also includes a first window in the user interface substantially adjacent to the century table; a second window in the user interface; a third window in the user interface substantially adjacent to the weekday table; a year table piece, having a century indicator that is movably displayed in the first window; and a year table, seven columns of which are movably displayed in the second window. A month/date table piece is also included, having a date table, seven columns of which are movably displayed in the third window; and a month table, seven columns of which are also movably displayed in the second window; an optional first lever coupled to the year table piece through a first lever channel in the user interface; and an optional second lever coupled to the month/date table piece through a second lever channel in the user interface.

15 Claims, 25 Drawing Sheets

PERPETUAL CALENDAR SYSTEM AND METHOD OF USE THEREOF

BACKGROUND

Whether for historical inquiry, or simply to appease curiosity, people often wonder what day of the week certain events took place, or will take place. For example, some may wonder what day of the week it was when Pearl Harbor was attacked. Some may wonder what day of the week the Declaration of Independence was signed. Some may wonder what day of the week New Year's Eve 2999 will be. And still others may wonder whether there has been a Friday the $13^{th}$ every year.

While it may be possible to determine this information by performing conventional calculations, such an approach is not desirable because 1) such calculations are long and complex and, as such, are not within the abilities of most people; and 2) their complexity and the level of expertise required to perform such calculations makes them exceedingly prone to error.

Therefore, there exists at present a need for a simple and portable means for calculating calendar information. Each of the foregoing issues, as well as others, is addressed by the present invention.

The present system is a truly perpetual calendar system, since it includes all possible months from January 0001 in the Julian calendar system into the foreseeable future in the Gregorian calendar system. This information can be displayed easily in the various embodiments of the present invention.

SUMMARY OF THE INVENTION

The invention as presently claimed is for a calendar system. The system includes a user interface having a century table; a weekday table; a first lever channel; and a second lever channel, both of which are optional. It is noted that as used herein, the term "weekday table" is simply a table of the days of the week. It is not intended to suggest a table that includes only Monday through Friday (and excludes weekends). A first window in the user interface is substantially adjacent to the century table. A third window in the user interface is substantially adjacent to the weekday table. The system also includes a second window in the user interface.

A year table piece has a century indicator that is movably displayed in the first window; and a year table, seven columns of which are movably displayed simultaneously in the second window. The system also includes a month/date table piece, having a month table, seven columns of which are also movably displayed in the second window; and a date table, seven columns of which are movably displayed simultaneously in the third window.

The system can also include a first set of alignment indicators on a bottom edge of the year table. Other embodiments include a second set of alignment indicators on a top edge of the month table.

In one embodiment, the system includes a first lever coupled to the year table piece through a first lever channel in the user interface; and a second lever coupled to the month/date table piece through a second lever channel in the user interface.

In one embodiment, the year table is represented in FIG. 2. In one embodiment, the year table is represented in FIG. 5. In another, the year table is represented in FIG. 22.

In one embodiment, the date table is represented in FIG. 3. In one embodiment, the date table is represented in FIG. 6. In one embodiment, the date table is represented in FIG. 22.

In one embodiment, the month table is represented in FIG. 3. In one embodiment, the month table is represented in FIG. 6. In one embodiment, the month table is represented in FIG. 22.

In one embodiment, the century table is represented in FIG. 1. In one embodiment, the century table is represented in FIG. 4. In one embodiment, the century table is represented in FIG. 21.

In general, it is to be noted that although the Julian table shown in the figures ends with the century year 30, this is not a limit for the present invention. The values in each column increase in steps of four, thus the proper column for centuries beyond 30 may be easily determined without further modification.

DETAILED DESCRIPTION OF THE DRAWINGS

Figure 1:
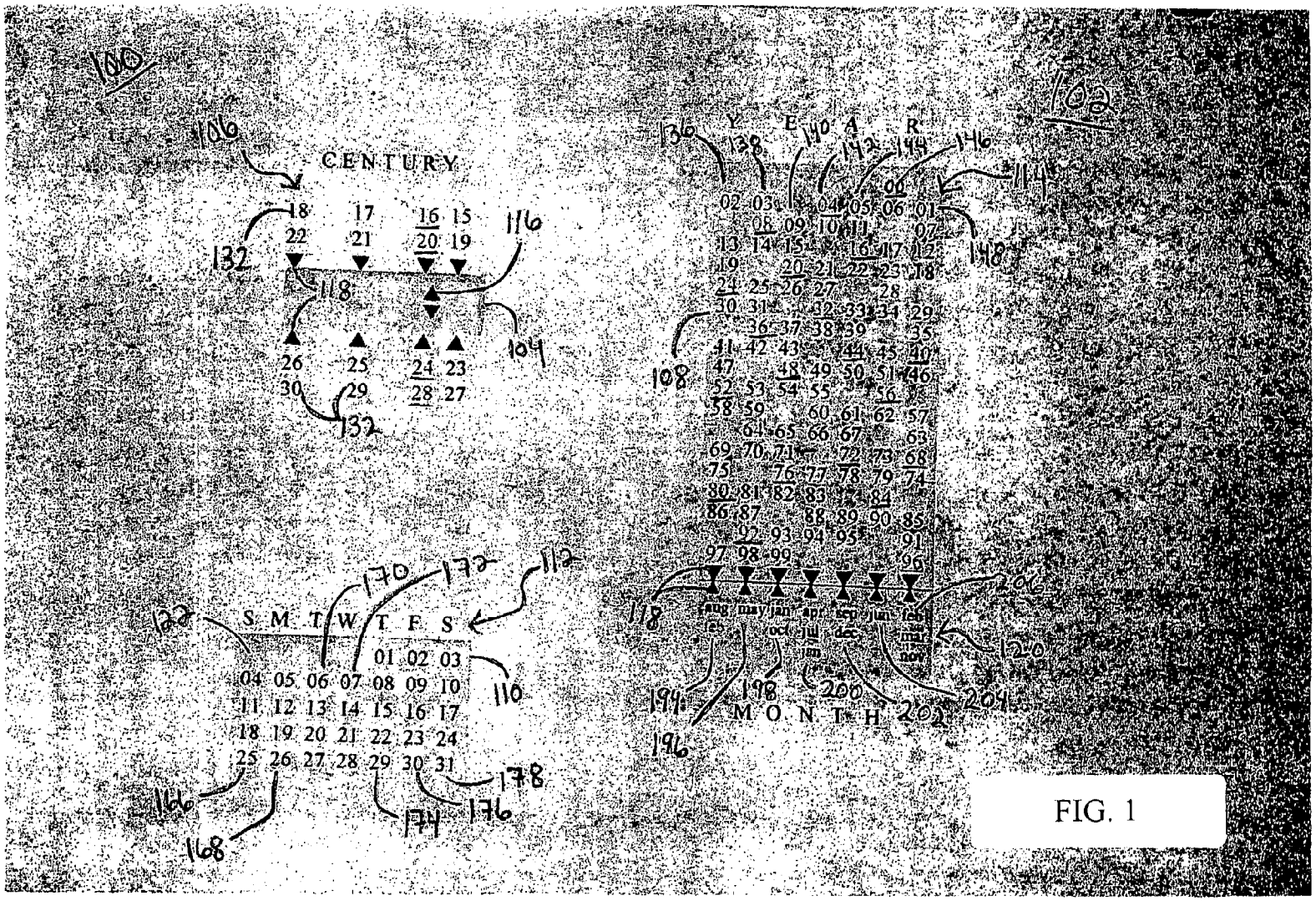
FIG. 1 shows a perpetual calendar system according to one embodiment of the present invention.

In FIG. 1 is shown a Gregorian calendar system 100 according to one embodiment of the present invention. The system includes a user interface 102 having a first window (or century indicator window) 104 with a century table 106 associated therewith, which includes a plurality of century columns 132. A second window (or year window) 108 and a third window (date window) 110 are also featured in the user interface 102. The third window 110 in this embodiment also includes a weekday (i.e. day of the week) table 112.

Seven columns 136, 138, 140, 142, 144, 146, 148 of year table 114 and a century indicator 116 are also seen. Alignment indicators 118 help a user to line up the desired month with the desired year. The present embodiment also includes a month table 120 and a date table 122. Seven columns 194, 196, 198, 200, 202, 204, 206 of the month table 120 and seven columns 166, 168, 170, 172, 174, 176, 178 of the date table 122 are visible through windows 108 and 110 respectively.

Figure 2:
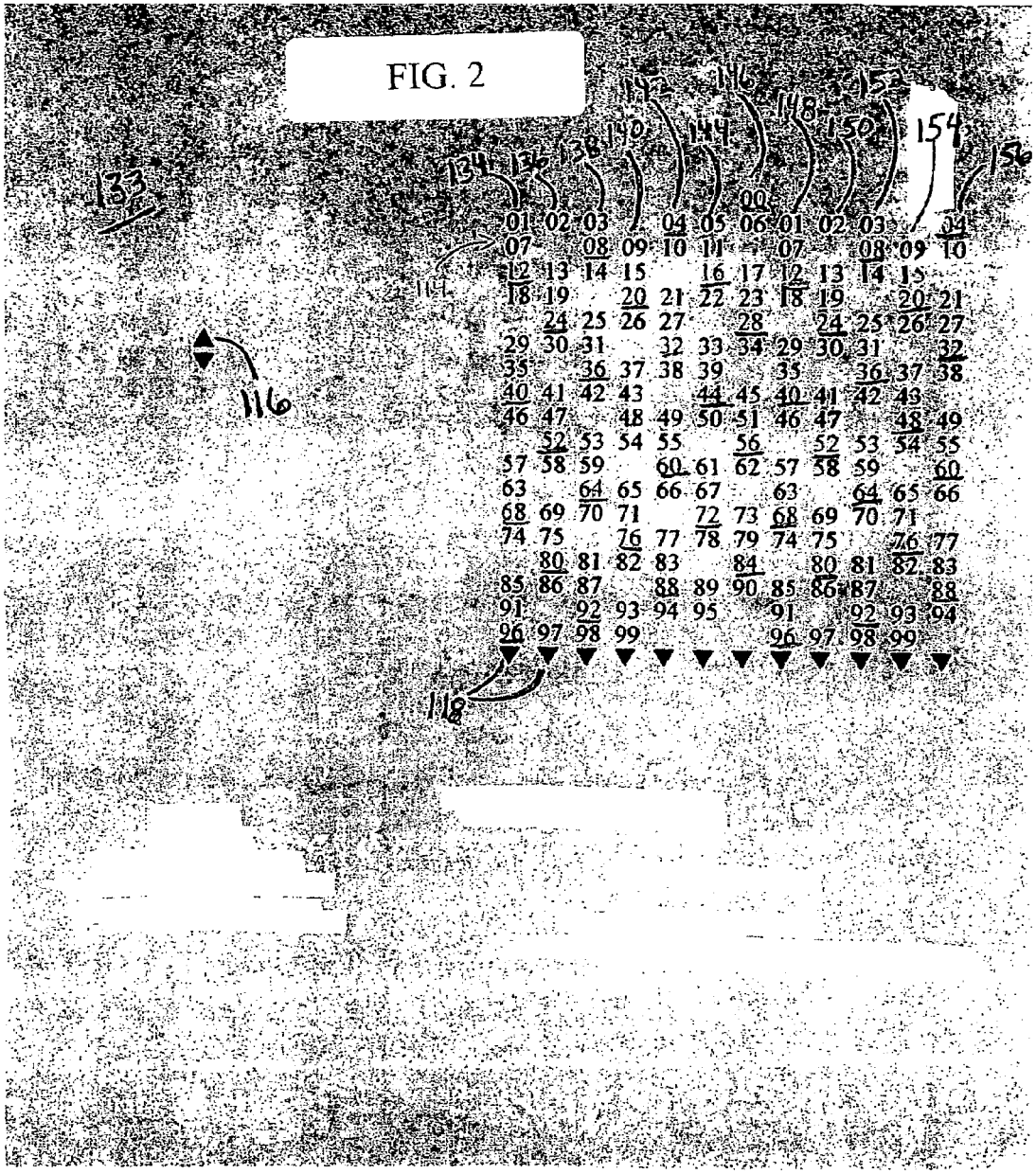
FIG. 2 shows a year table piece corresponding to the calendar system of FIG. 1, according to one embodiment of the present invention.

In FIG. 2 is shown a more detailed view of a year table piece 133. This piece includes twelve year columns 134, 136, 138, 140, 142, 144, 146, 148, 150, 152, 154, 156. In this embodiment, the century indicator 116 is also on the year table piece 133.

Figure 3:
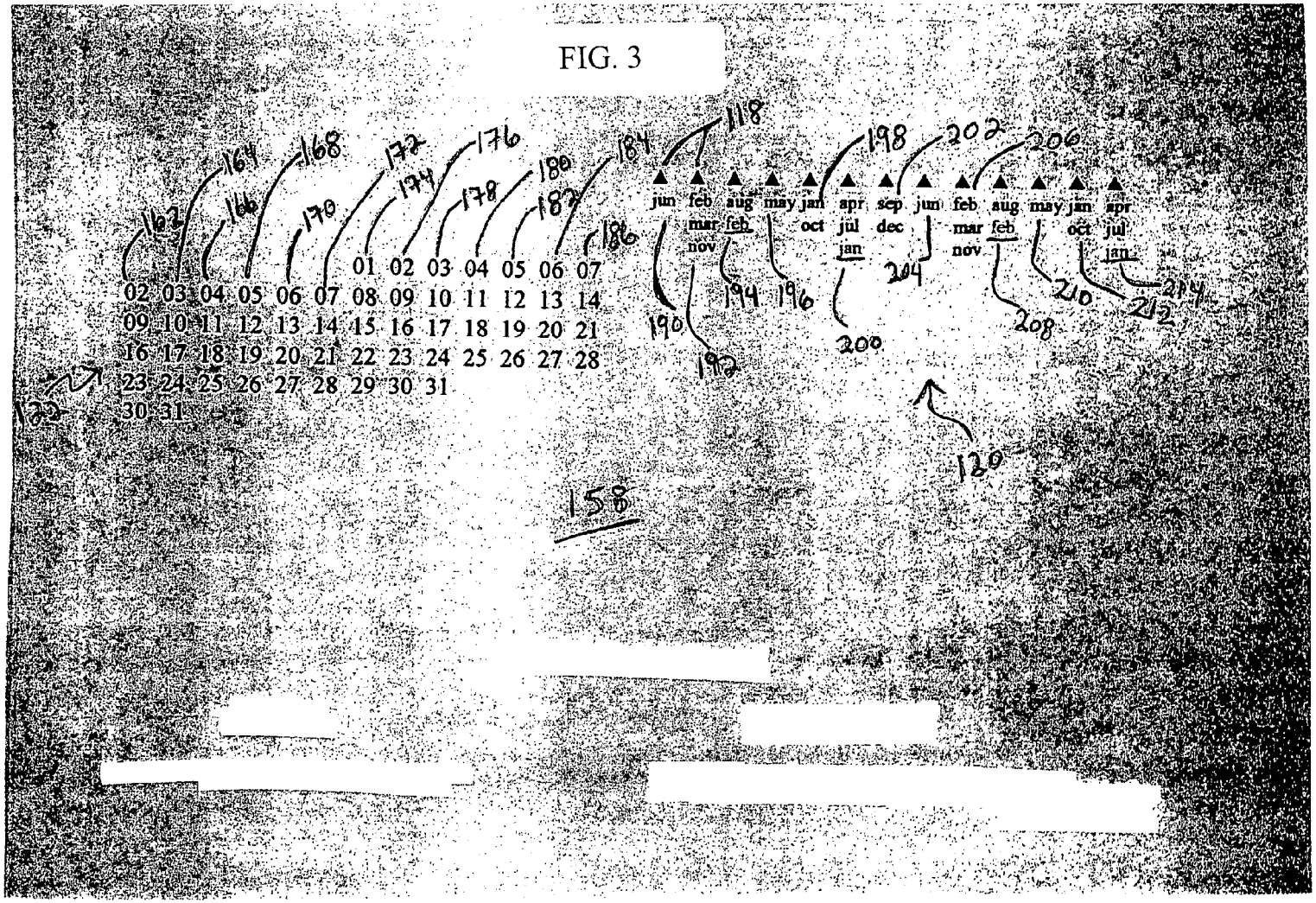
FIG. 3 shows a month/date table piece corresponding to the calendar system of FIG. 1, according to one embodiment of the present invention.

FIG. 3 shows a more detailed view of a month/date table piece 158. This piece 158 includes date columns 162, 164, 166, 168, 170, 172, 174, 176, 178, 180, 182, 184, 186. It also includes month columns 190, 192, 194, 196, 198, 200, 202, 204, 206, 208, 210, 212, 214.

It is noted that on the year table 114 in FIG. 2, the double zero (00) year, as well as all the other years that are divisible by four are underscored. Certain months are also underscored in the month table 120 of FIG. 3. As will become more apparent in the discussion of the operation of the present invention, this notation system is needed for the proper display of leap years.

Figure 4:
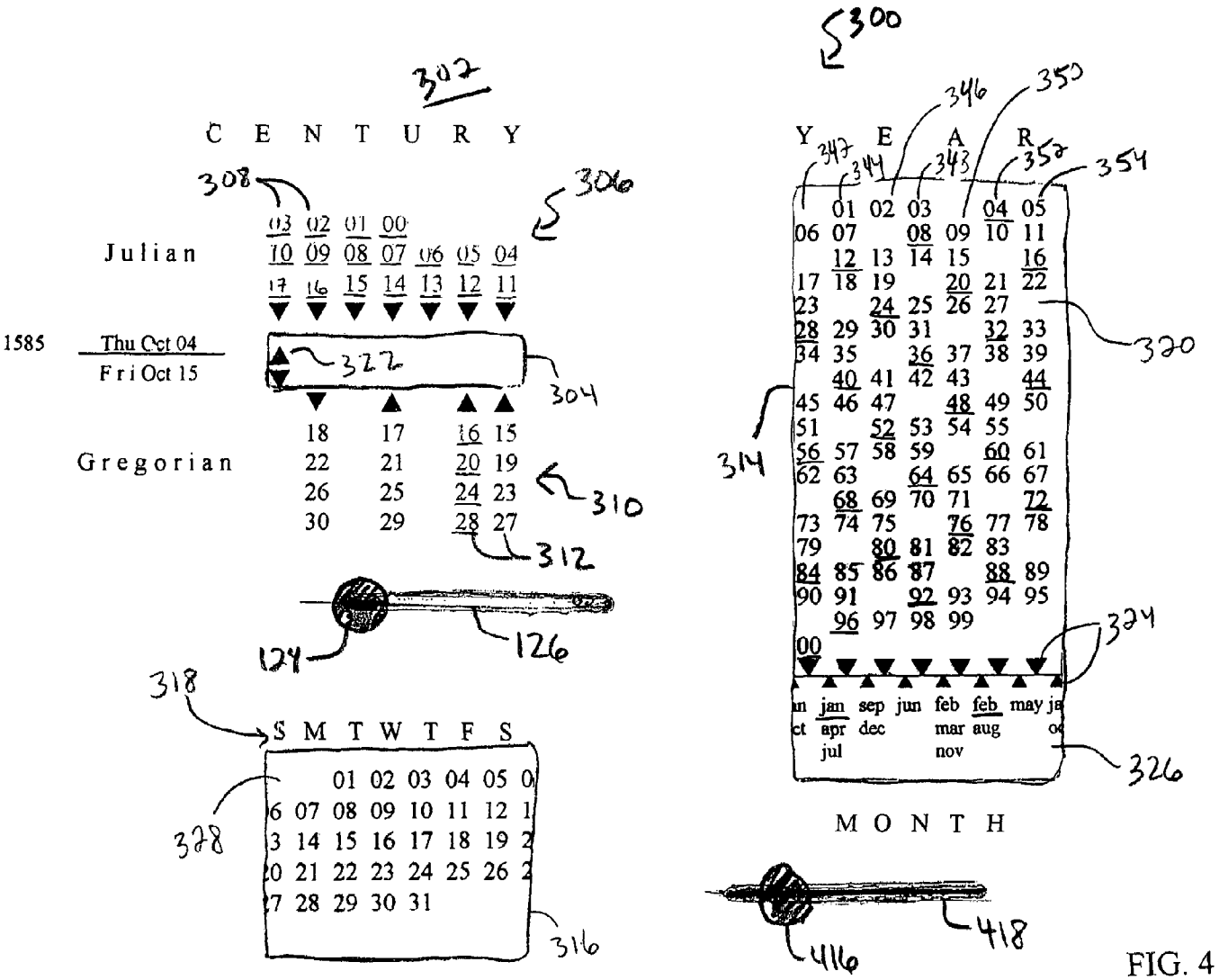
FIG. 4 shows a perpetual calendar system according to another embodiment of the present invention.

FIG. 4 shows a perpetual calendar system 300 according to another embodiment of the present invention. This particular embodiment includes both Julian and Gregorian century tables. This system 300 includes a user interface 302 that includes a first window (or century indicator window) 304, a Julian century table 306 that has various columns 308. It also includes a Gregorian table 310, likewise having a variety of columns 312. The interface 302 includes a second window (or year window) 314, and a third window (date window) 316. As with the embodiment previously discussed, the system also includes a weekday table 318, a year table 320, and a century indicator 322. Alignment indicators 324 are also included to help a user more precisely line up month and year data.

A month table 326 and a date table 328 are also featured in this embodiment. It is noted that these tables are the same as has been discussed in connection with FIGS. 1-3. However, inasmuch as this embodiment includes both Julian and Gregorian calendar data, the year table 320 is slightly different than has been discussed previously.

This embodiment further includes a handle or lever 124 that extends through slot or lever channel 126, and a second lever or handle 416 that extends through lever channel or slot 418.

It is also noted that the date table window 316 (FIG. 4) always displays a 31-day month. Of course, this holds true for January, March, May, July, August, October and December. Nevertheless, as would be apparent to a user, the remaining months would only count 30 days except for February 29 days in a leap year, 28 days in a non-leap year (i.e. in those months the days beyond 30, 29 and 28 respectively, would be ignored by the user).

Figure 5:
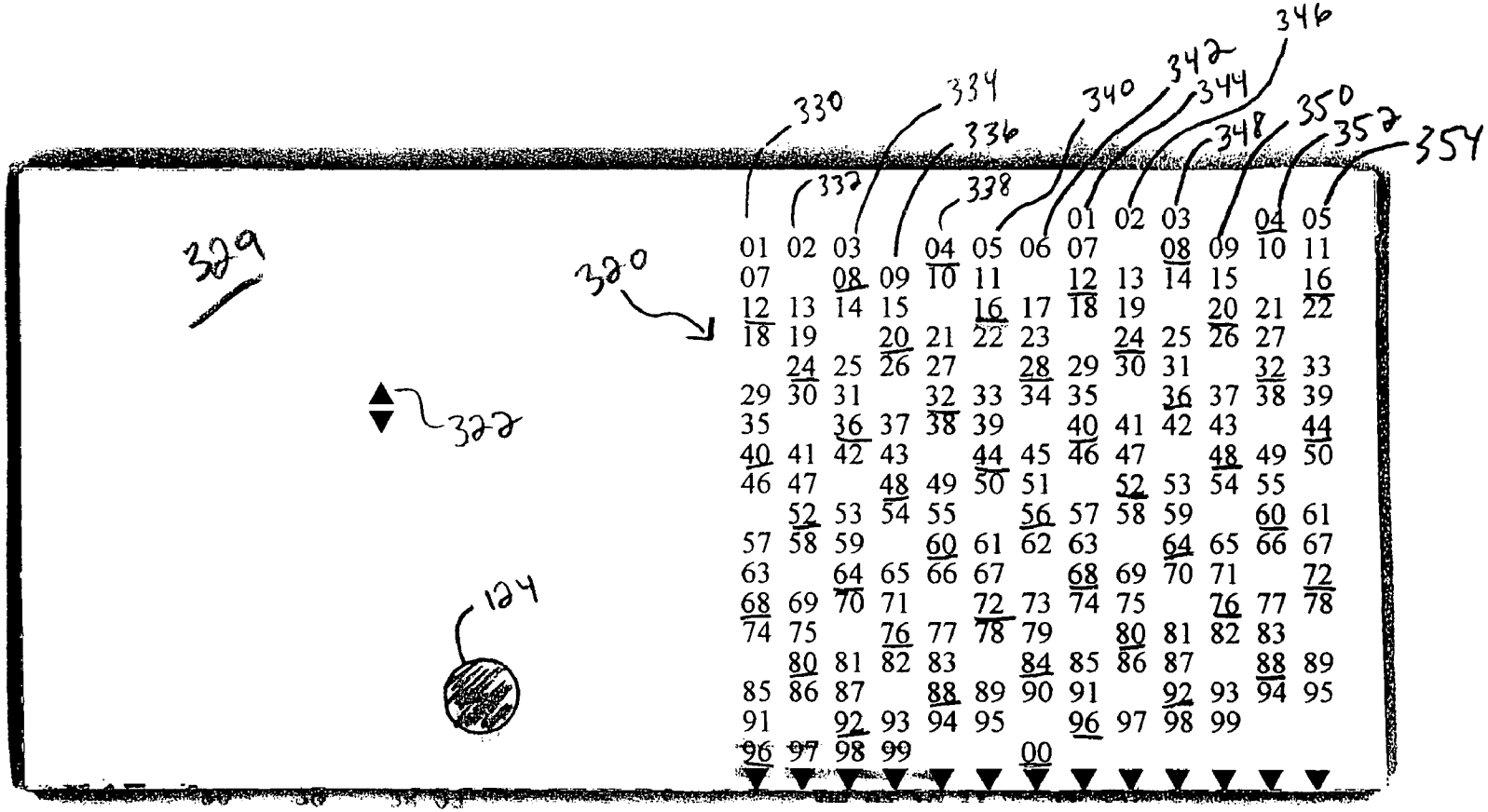
FIG. 5 shows a year table piece corresponding to the calendar system of FIG. 4, according to one embodiment of the present invention.

FIG. 5 shows a year table piece 329 corresponding to the calendar system of FIG. 4, according to one embodiment of the present invention. In this piece 329, the year table 320 includes thirteen columns 330, 332, 334, 336, 338, 340, 342, 344, 346, 348, 350, 352, 354. Seven of these columns 342, 344, 346, 348, 350, 352, 354 are visible in the window 314 shown in FIG. 4.

The year table piece 329 also includes the century indicator 322. Handle 124 is coupled to the piece 329, and extends up into the user interface 302 (FIG. 4) through lever channel 126 (FIG. 4).

Figure 6:
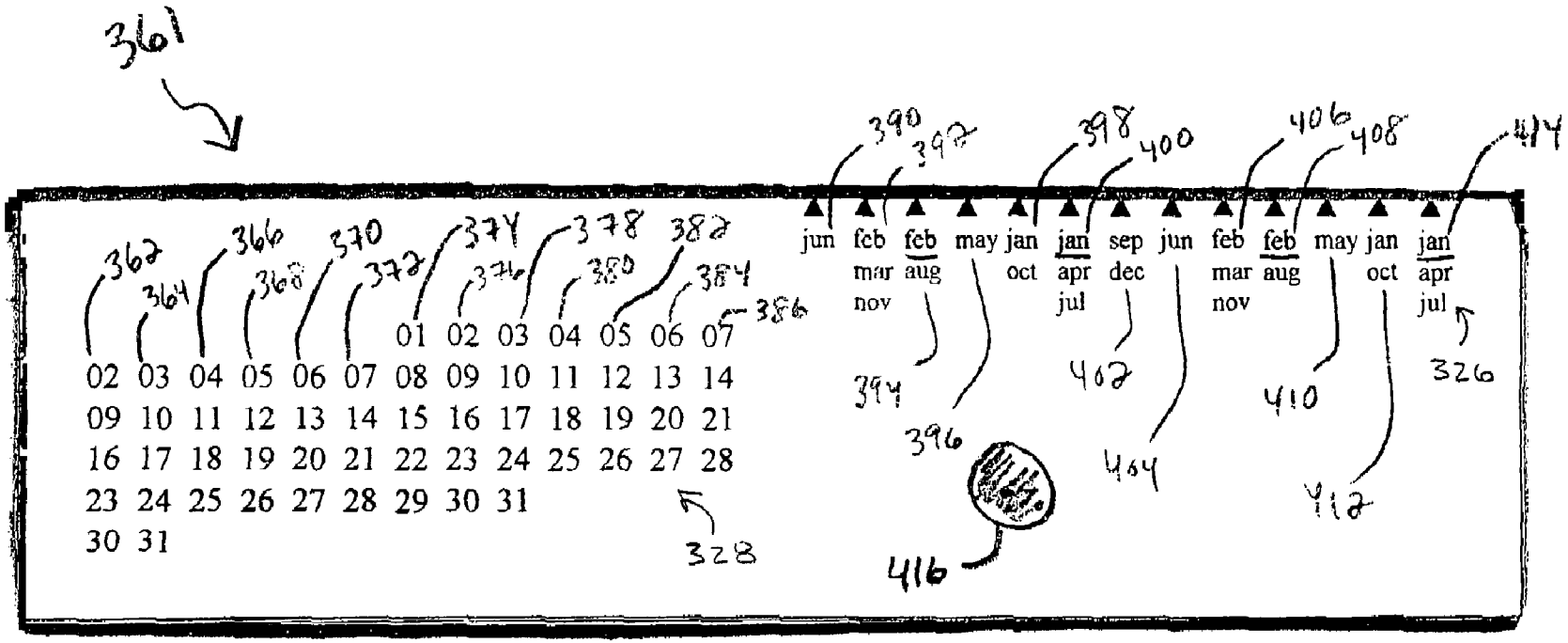
FIG. 6 shows a month/date table piece corresponding to the calendar system of FIG. 4, according to one embodiment of the present invention.

FIG. 6 shows a month/date table piece 361 corresponding to the calendar system of FIG. 4, according to one embodiment of the present invention. This piece 361 shows more fully the date table 328, which has thirteen columns 362, 364, 366, 368, 370, 372, 374, 376, 378, 380, 382, 384, 386. Also shown is the month table 326, which similarly has thirteen columns 390, 392, 394, 396, 398, 400, 402, 404, 406, 408, 410, 412, 414.

Handle 416 is coupled to piece 361 and extends up into the user interface 302 (FIG. 4) through channel 418.

To better illustrate the mode and manner of operation of the present device in its various embodiments, reference is made to FIGS. 7-13. These show the year table piece (see FIG. 5) as it appears through the user interface windows. The various possible positions of the century indicator 322 are shown relative to the century tables 306, 310 (see FIG. 4) and the corresponding visible columns of the year table 320 (see FIG. 5).

Figure 7:
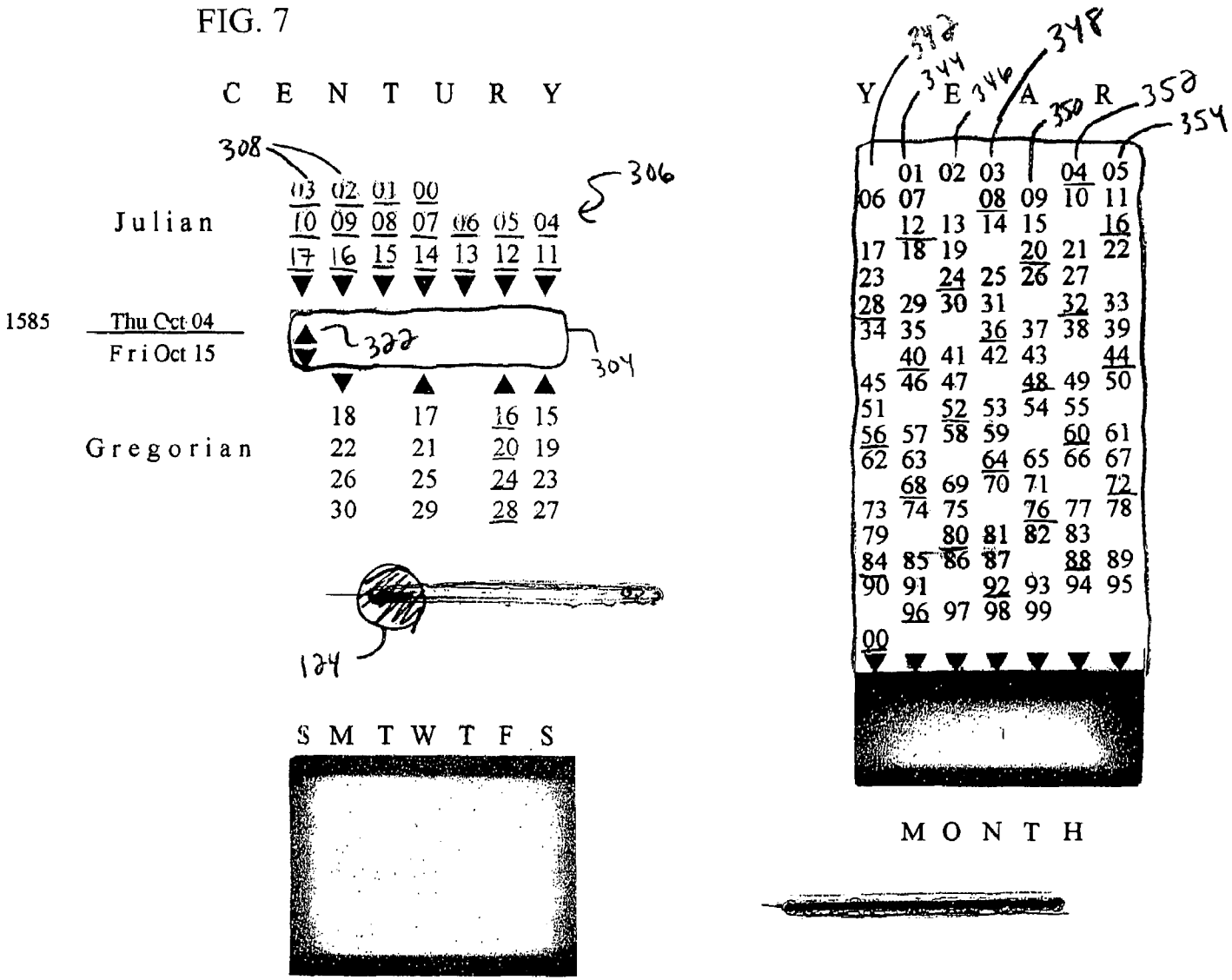
FIG. 7 shows the calendar system of FIG. 4 having the year table and century indicator in a first position.

Specifically, FIG. 7 shows the century indicator 322 in a first position, such that it aligns with the centuries 03, 10 and 17 in the Julian calendar. When the century indicator 322 is so aligned, then columns 342, 344, 346, 348, 350, 352, 354 of the year table 320 are visible in window 314 (see FIG. 4).

Figure 8:
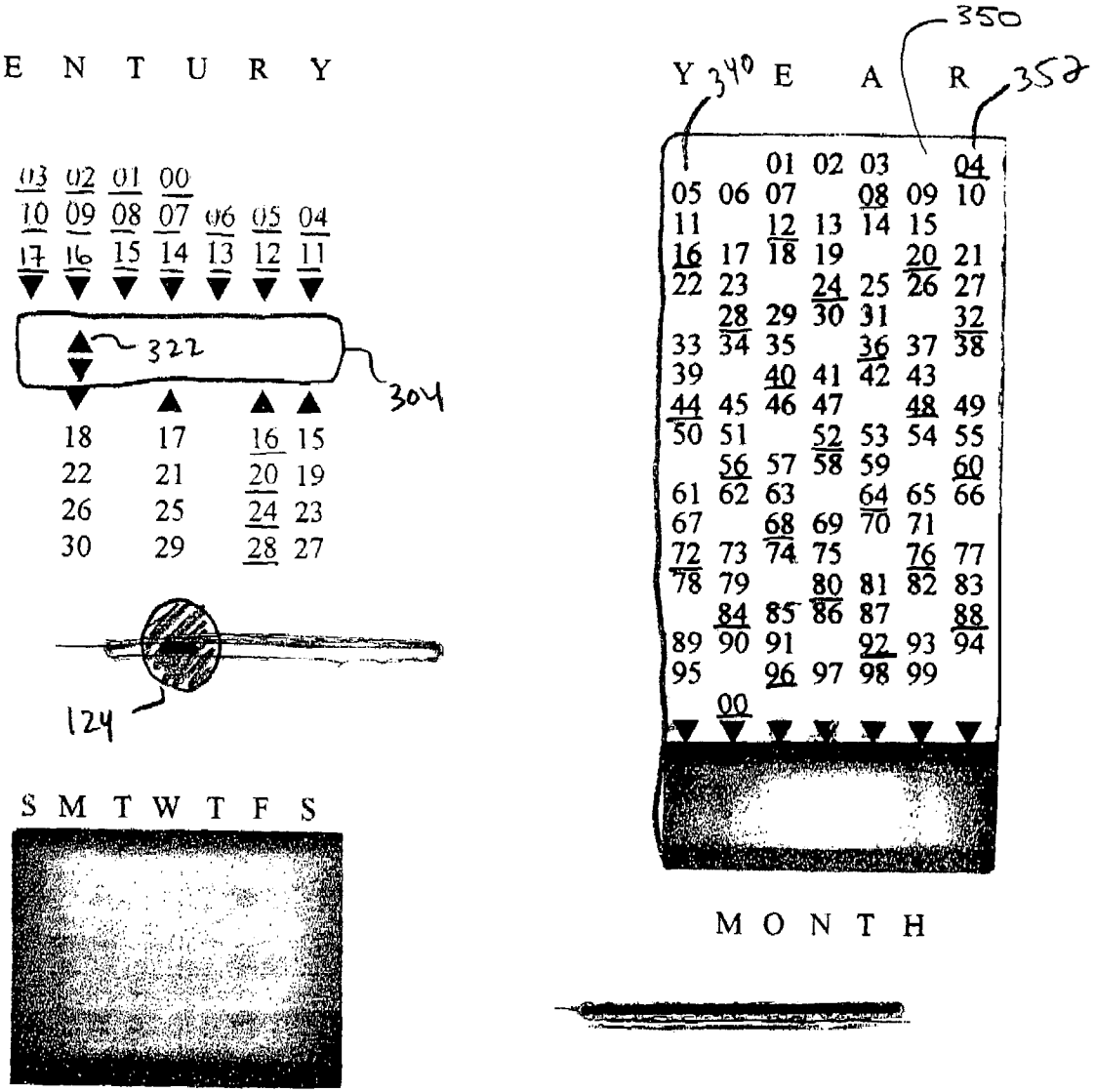
FIG. 8 shows the calendar system of FIG. 4 having the year table and century indicator in a second position.

FIG. 8 illustrates the relative display of the century and year tables when a user moves the year table piece 329 slightly to the right. In this case, the indicator 322 is aligned with the centuries 02, 09 and 16 in the Julian calendar, and 18, 22, 26 and 30 in the Gregorian calendar. When the century indicator 322 is so aligned, then columns 340, 342, 344, 346, 348, 350, 352 of the year table 320 are visible in window 314.

Figure 9:
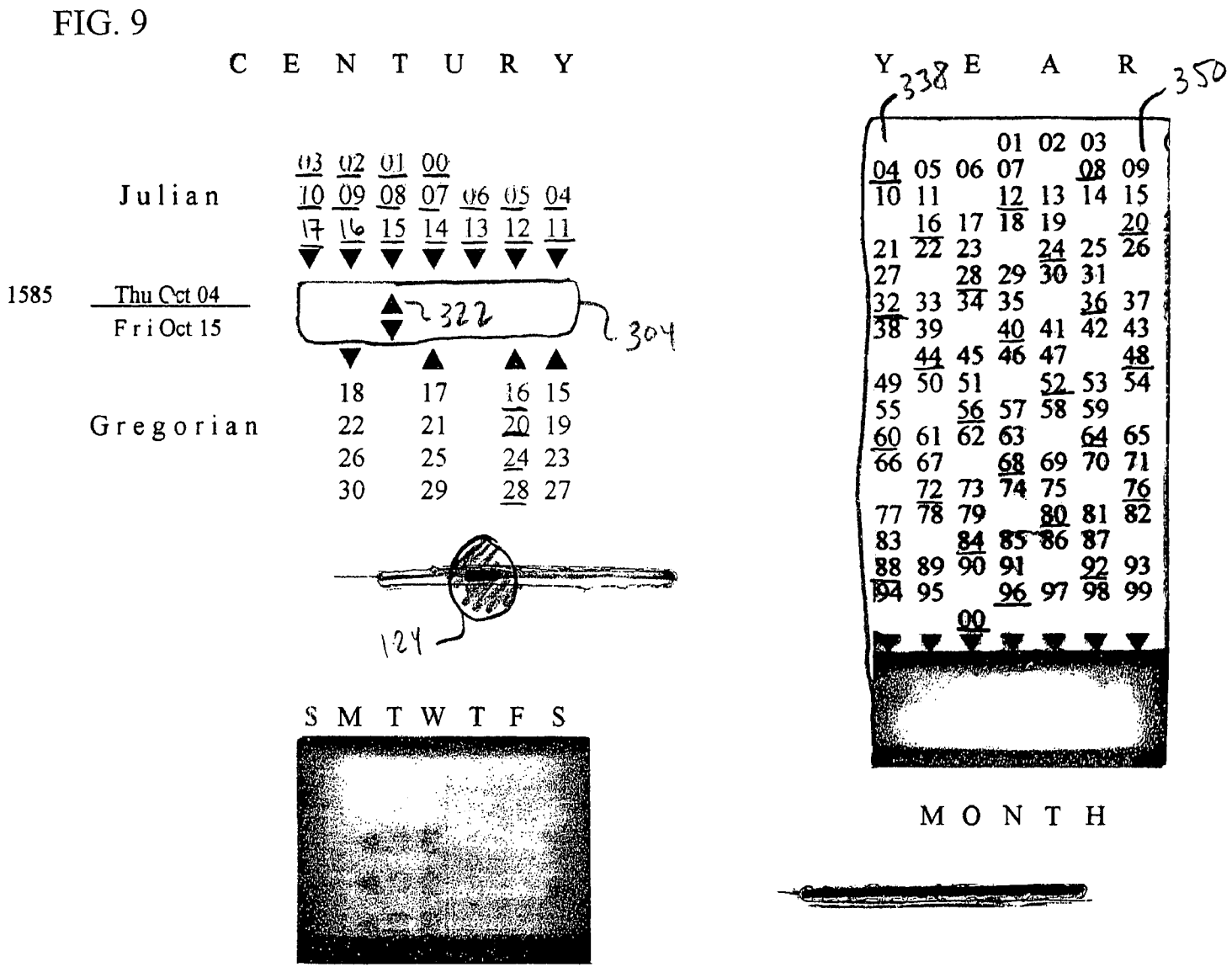
FIG. 9 shows the calendar system of FIG. 4 having the year table and century indicator in a third position.

Likewise, as seen in FIG. 9, alignment of the century indicator 322 in a third position—i.e. such that it aligns with the centuries 01, 08 and 15 in the Julian calendar—causes columns 338, 340, 342, 344, 346, 348, 350 of the year table 320 to be displayed in window 314.

Figure 10:
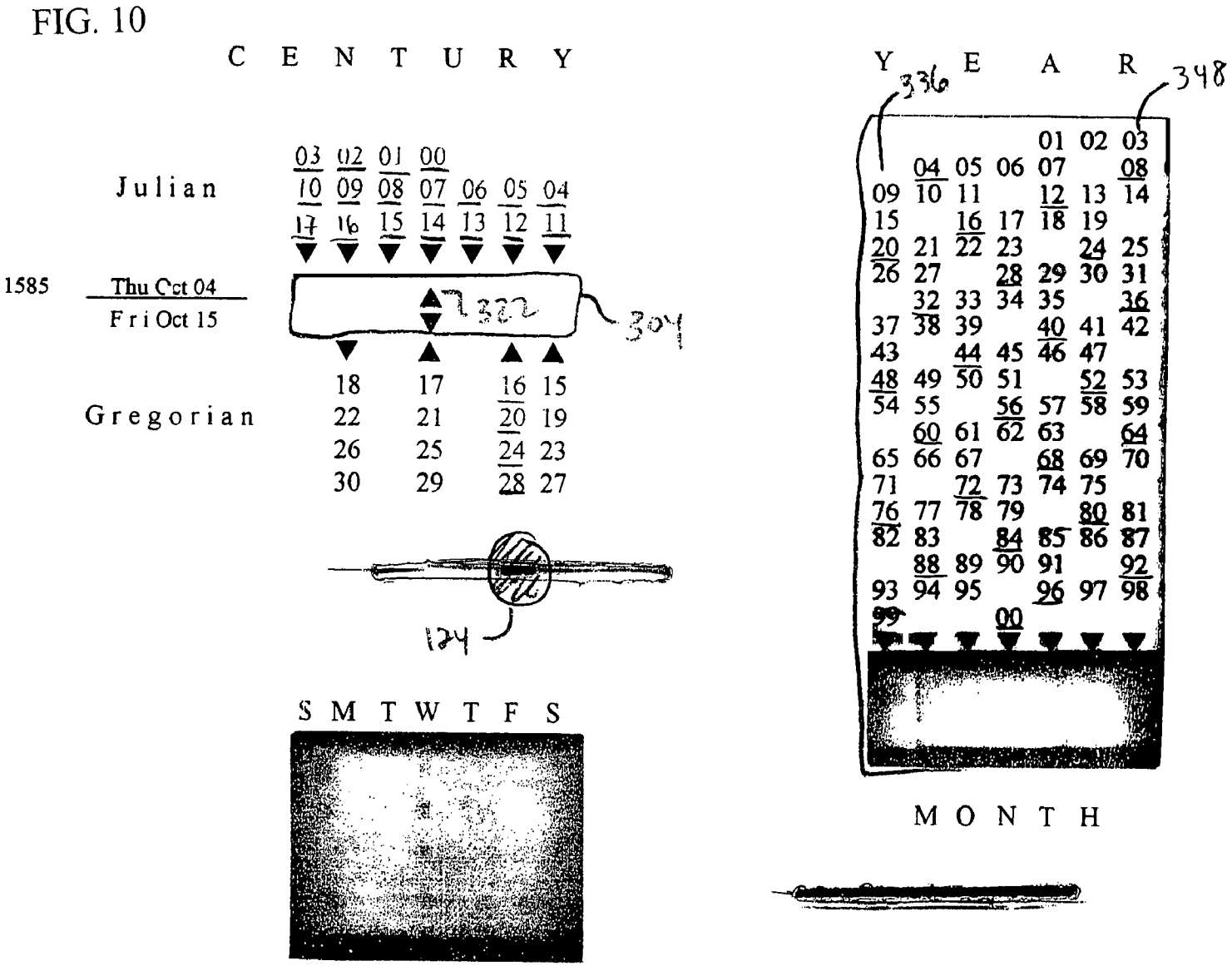
FIG. 10 shows the calendar system of FIG. 4 having the year table and century indicator in a fourth position.
Figure 11:
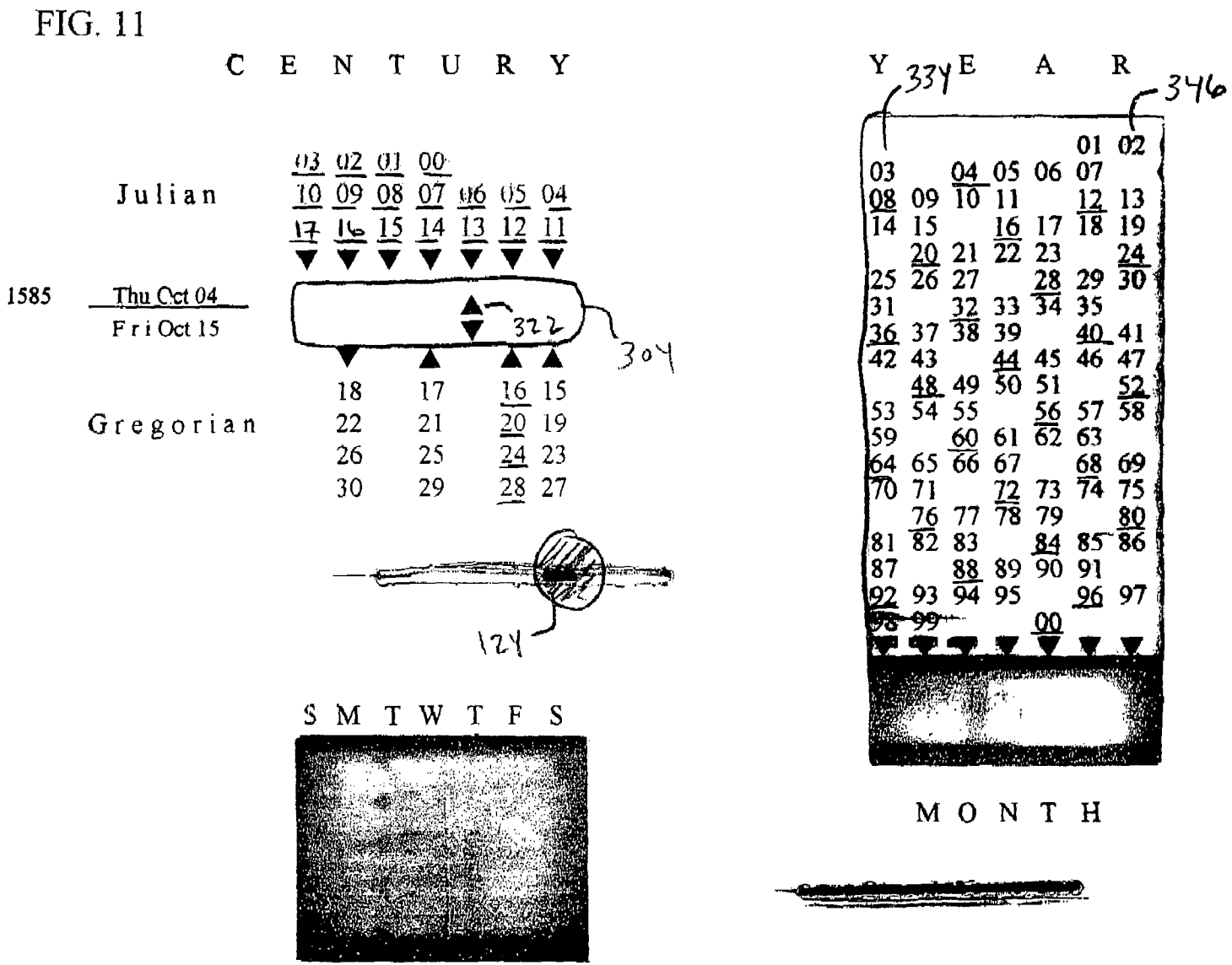
FIG. 11 shows the calendar system of FIG. 4 having the year table and century indicator in a fifth position.

Alignment of the century indicator 322 in a fourth position, as seen in FIG. 10—i.e. such that it aligns with the centuries 00, 07 and 14 in the Julian calendar, and 17, 21, 25, and 29 in the Gregorian calendar—causes columns 336, 338, 340, 342, 344, 346, 348 of the year table 320 to be displayed in window 314.

Alignment of the century indicator 322 in a fifth position, as seen in FIG. 1—i.e. such that it aligns with the centuries 06 and 13 in the Julian calendar—causes columns 334, 336, 338, 340, 342, 344, 346 of the year table 320 to be displayed in window 314.

Figure 12:
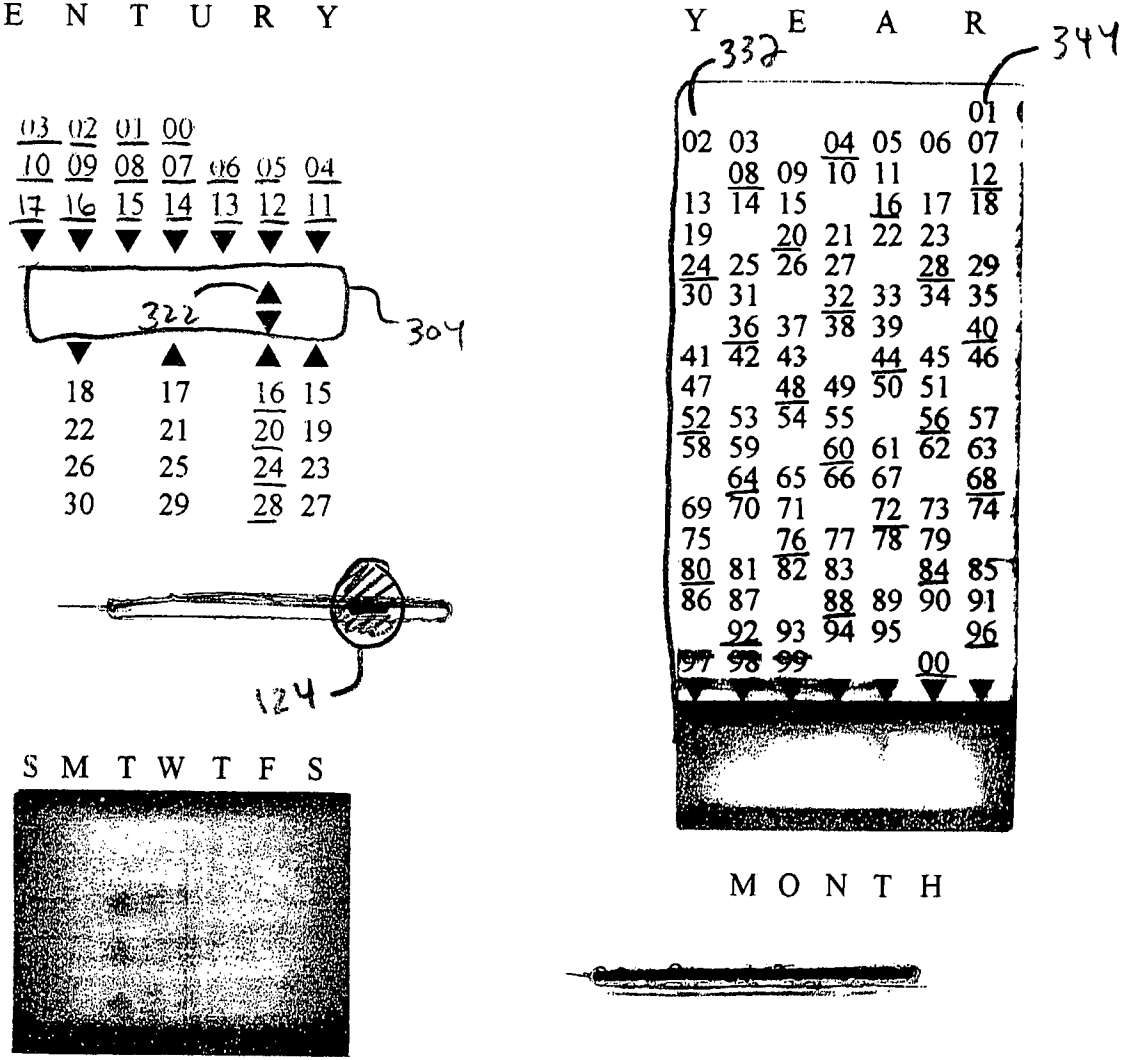
FIG. 12 shows the calendar system of FIG. 4 having the year table and century indicator in a sixth position.

Alignment of the century indicator 322 in a sixth position, as seen in FIG. 12—i.e. such that it aligns with the centuries 05 and 12 in the Julian calendar, and 16, 20, 24, and 28 in the Gregorian calendar—causes columns 332, 334, 336, 338, 340, 342, 344 of the year table 320 to be displayed in window 314.

Figure 13:
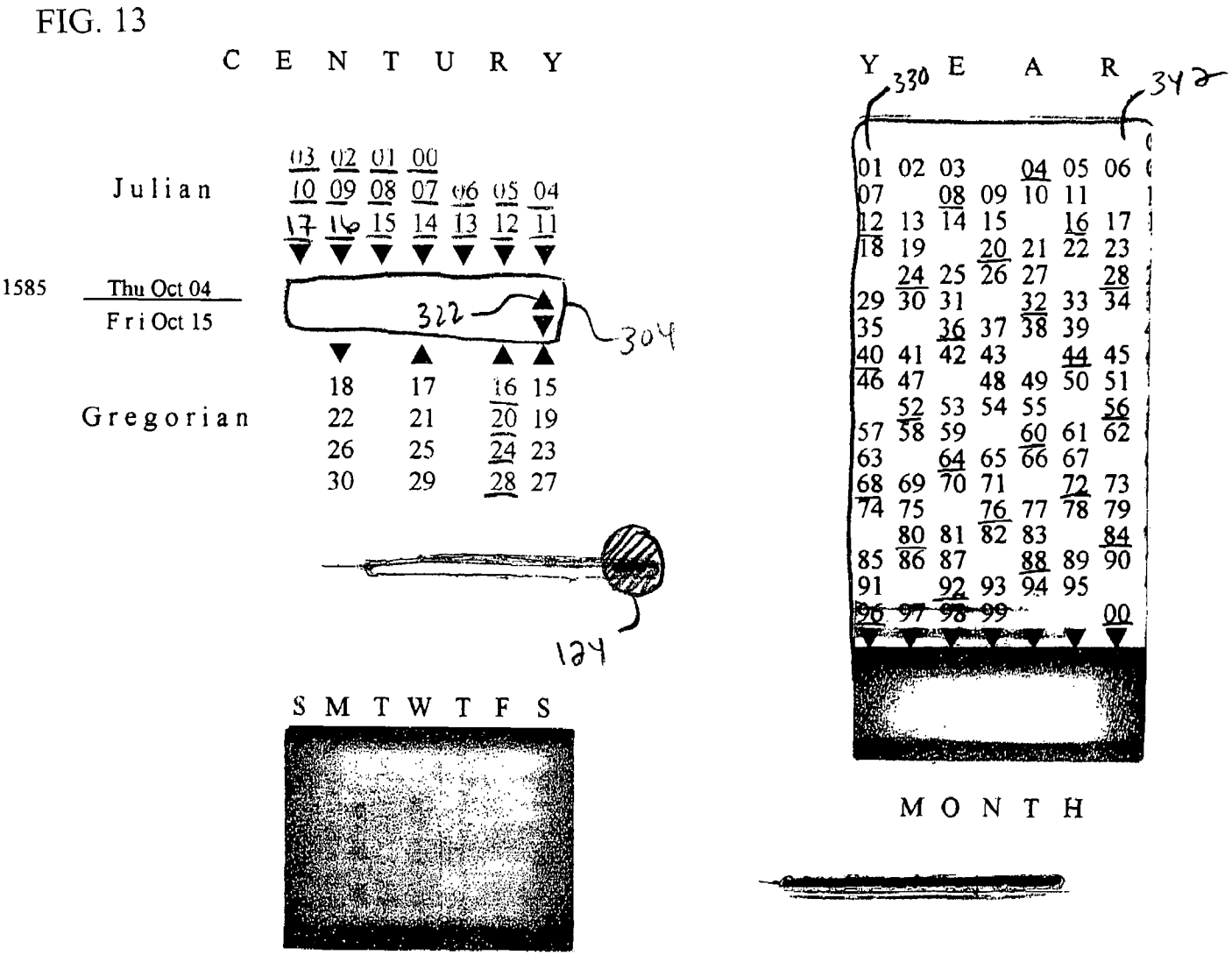
FIG. 13 shows the calendar system of FIG. 4 having the year table and century indicator in a seventh position.

Alignment of the century indicator 322 in a seventh position, as seen in FIG. 13—i.e. such that it aligns with the centuries 04 and 11 in the Julian calendar, and 15, 19, 23, and 27 in the Gregorian calendar—causes columns 330, 332, 334, 336, 338, 340, 342 of the year table 320 to be displayed in window 314.

FIGS. 14-20 show the various positions of the month/date tables. It is further noted that when the date being researched falls in January or February of a leap year, the underscored month is used to position the month/date table piece (as seen in FIGS. 3 and 6).

To further illustrate the mode and manner of operation of the present device in its various embodiments, reference is made to FIGS. 14-20. These show the month/date table piece in each of its various possible positions as it appears through the user interface windows.

Figure 14:
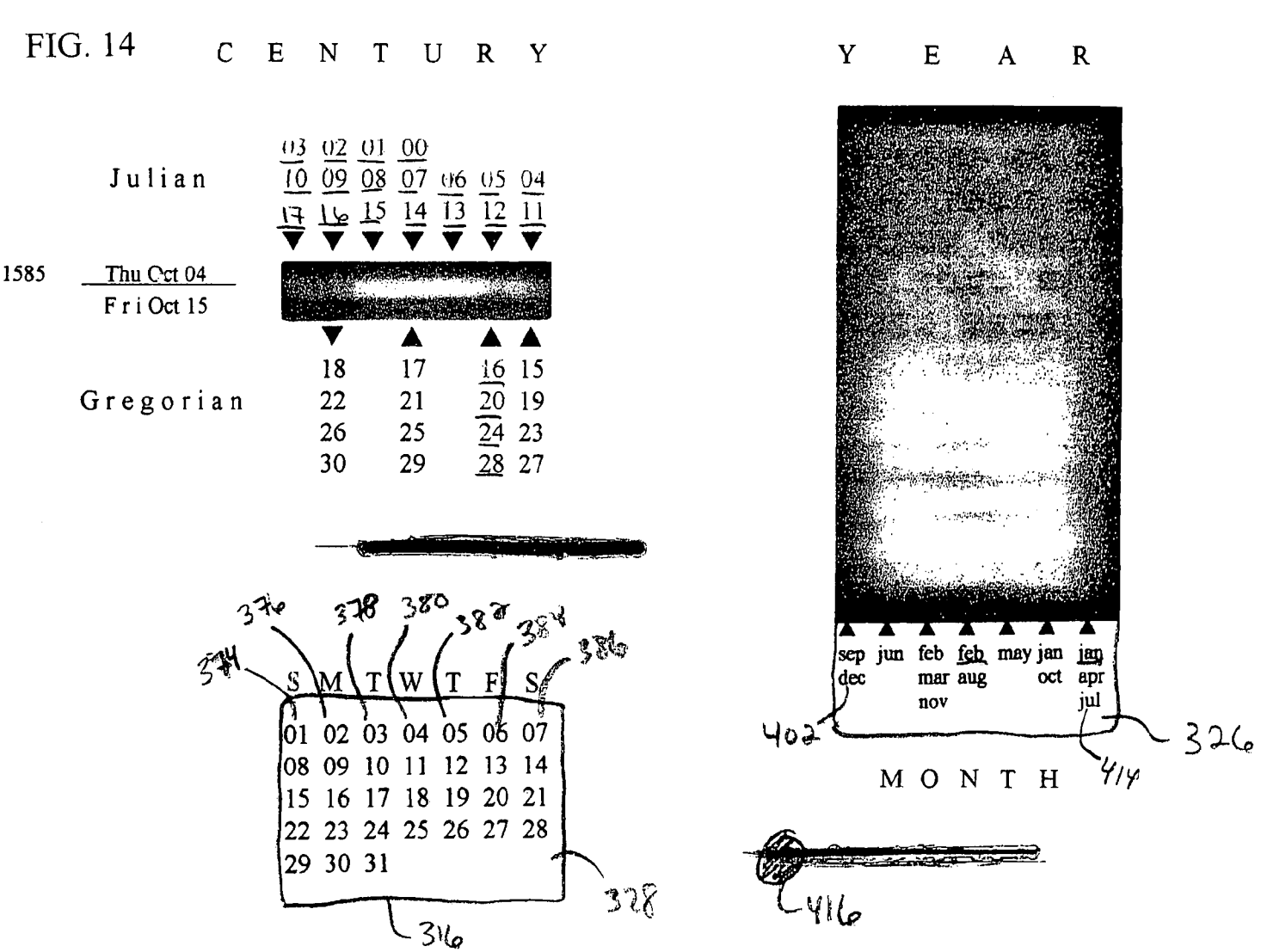
FIG. 14 shows the calendar system of FIG. 4 having the month/date tables in a first position.

Specifically, FIG. 14 shows the month table 326 in a first position. When the month table 326 is so aligned, columns 374, 376, 378, 380, 382, 384, 386 of the date window are visible in window 316.

Figure 15:
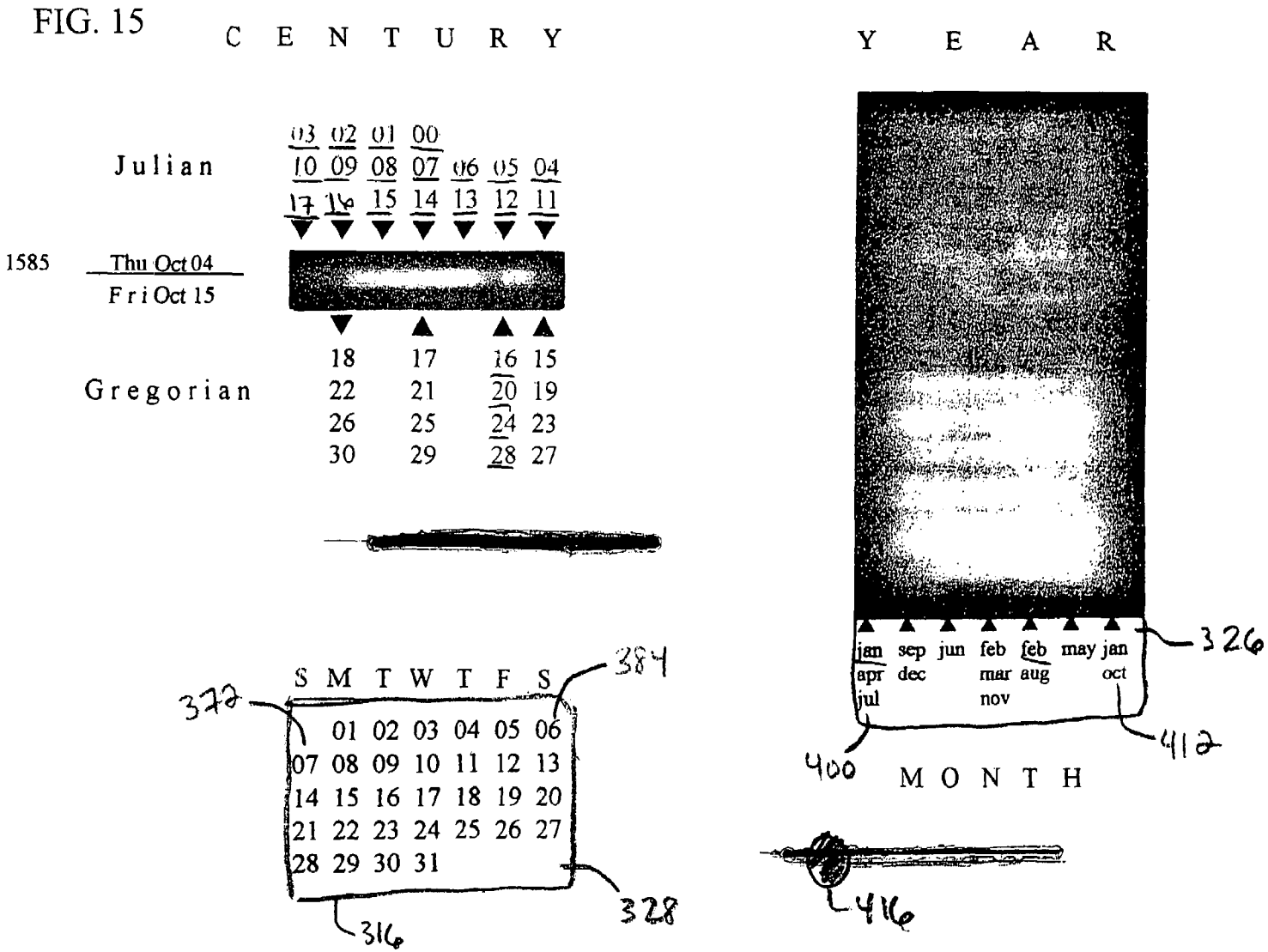
FIG. 15 shows the calendar system of FIG. 4 having the month/date tables in a second position.

When the month table 326 is in a second position (i.e. by a user moving the month/date table piece 361 to the right), as seen in FIG. 15, the first column. visible in the date window 316 is column 372, and the last column visible in the window is column 384.

Figure 16:
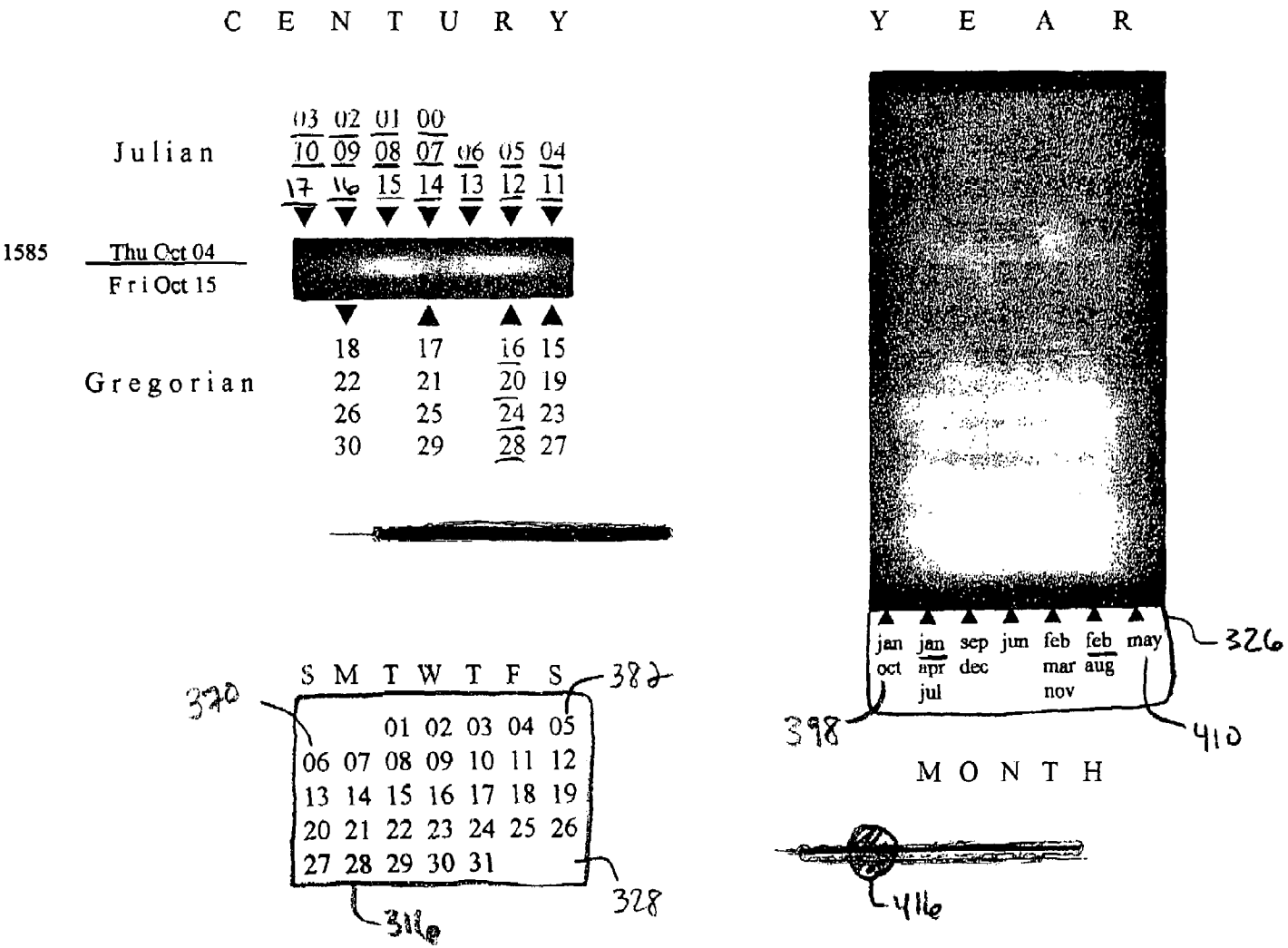
FIG. 16 shows the calendar system of FIG. 4 having the month/date tables in a third position.

When the month table 326 is in a third position, as seen in FIG. 16, the first column visible in the date window 316 is column 370, and the last column visible in the window is column 382.

Figure 17:
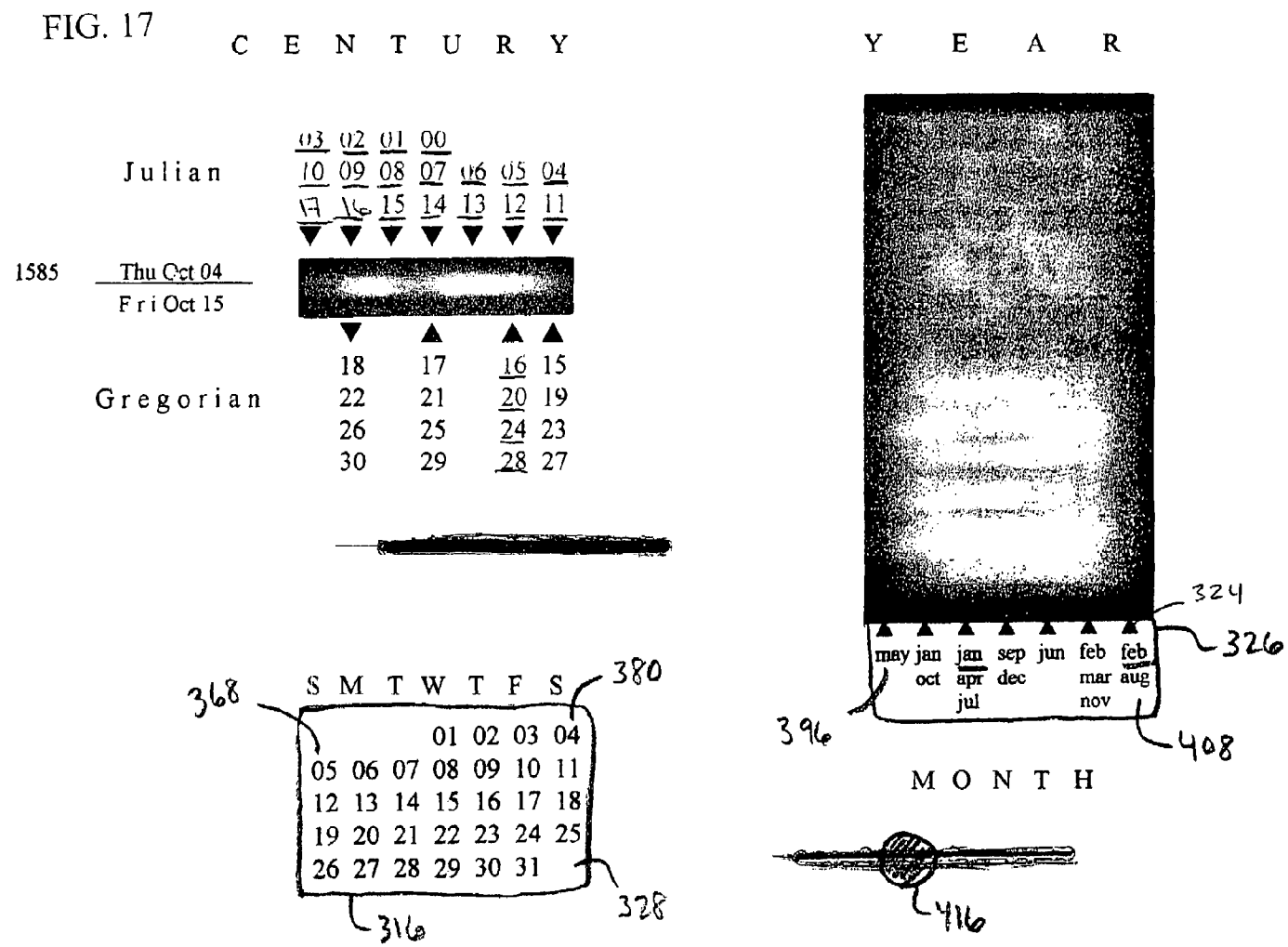
FIG. 17 shows the calendar system of FIG. 4 having the month/date tables in a fourth position.

When the month table 326 is in a fourth position, as seen in FIG. 17, the first column visible in the date window 316 is column 368, and the last column visible in the window is column 380.

Figure 18:
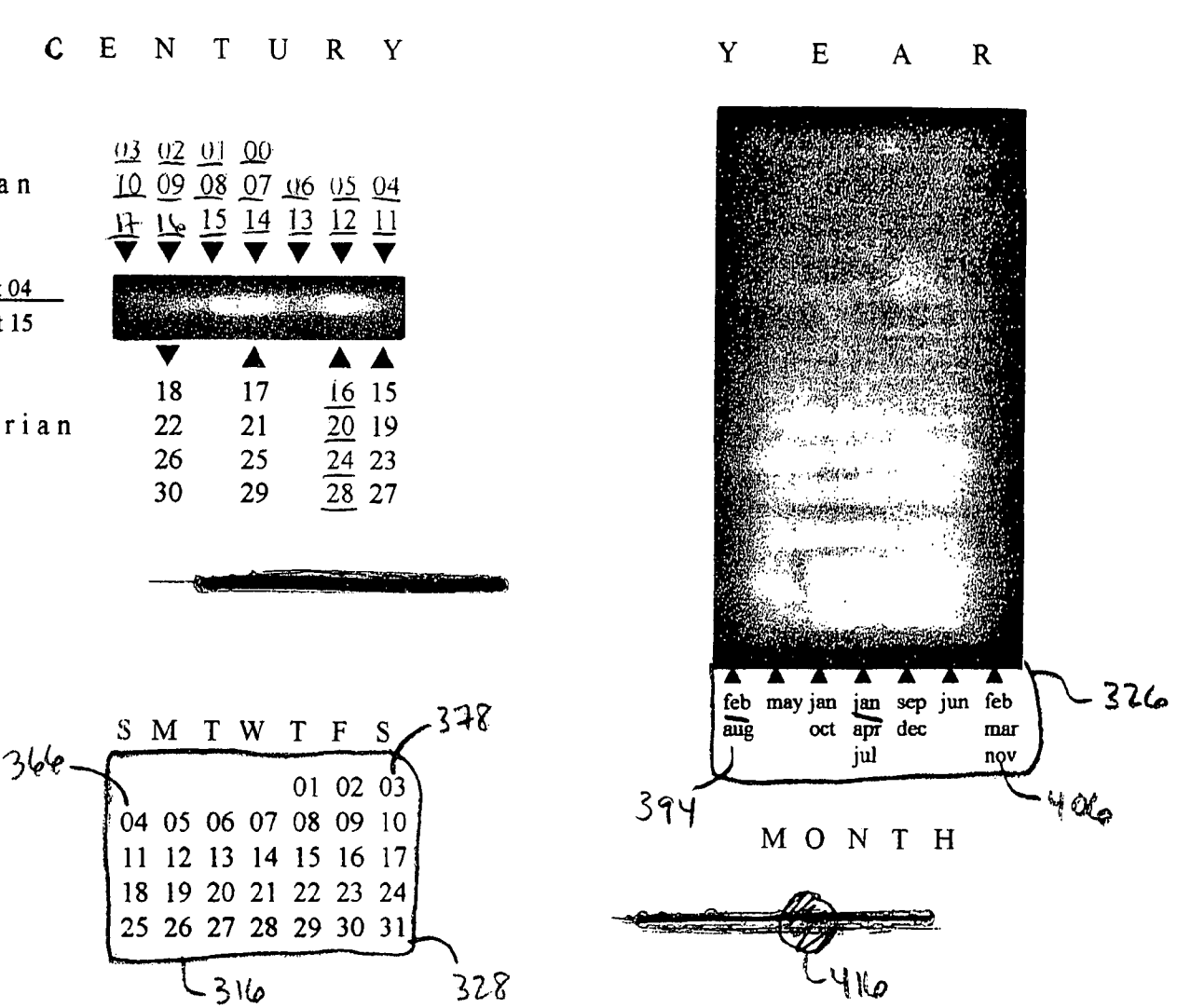
FIG. 18 shows the calendar system of FIG. 4 having the month/date tables in a fifth position.

When the month table 326 is in a fifth position, as seen in FIG. 18, the first column visible in the date window 316 is column 366, and the last column visible in the window is column 378.

Figure 19:
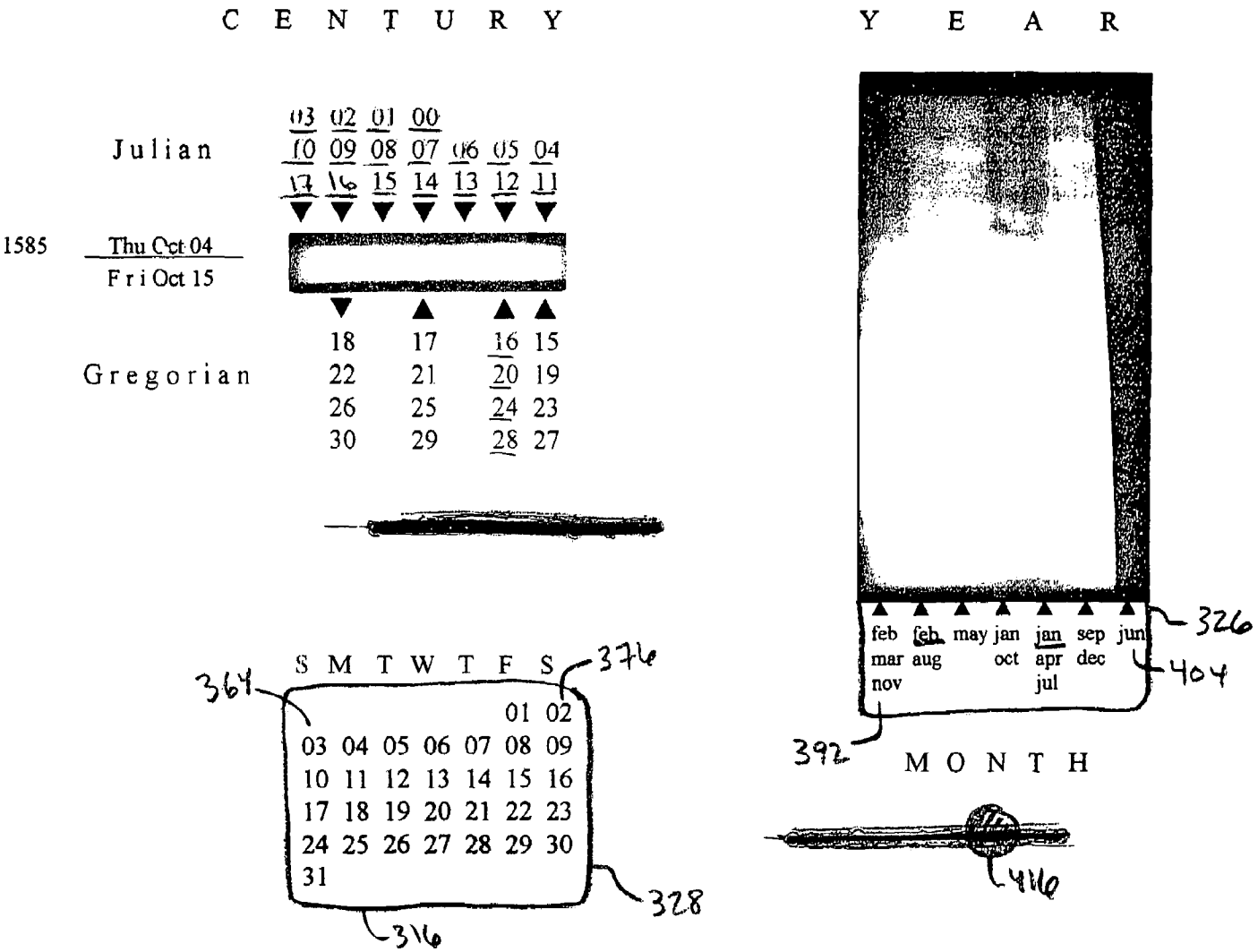
FIG. 19 shows the calendar system of FIG. 4 having the month/date tables in a sixth position.

When the month table 326 is in a sixth position, as seen in FIG. 19, the first column visible in the date window 316 is column 364, and the last column visible in the window is column 376.

Figure 20:
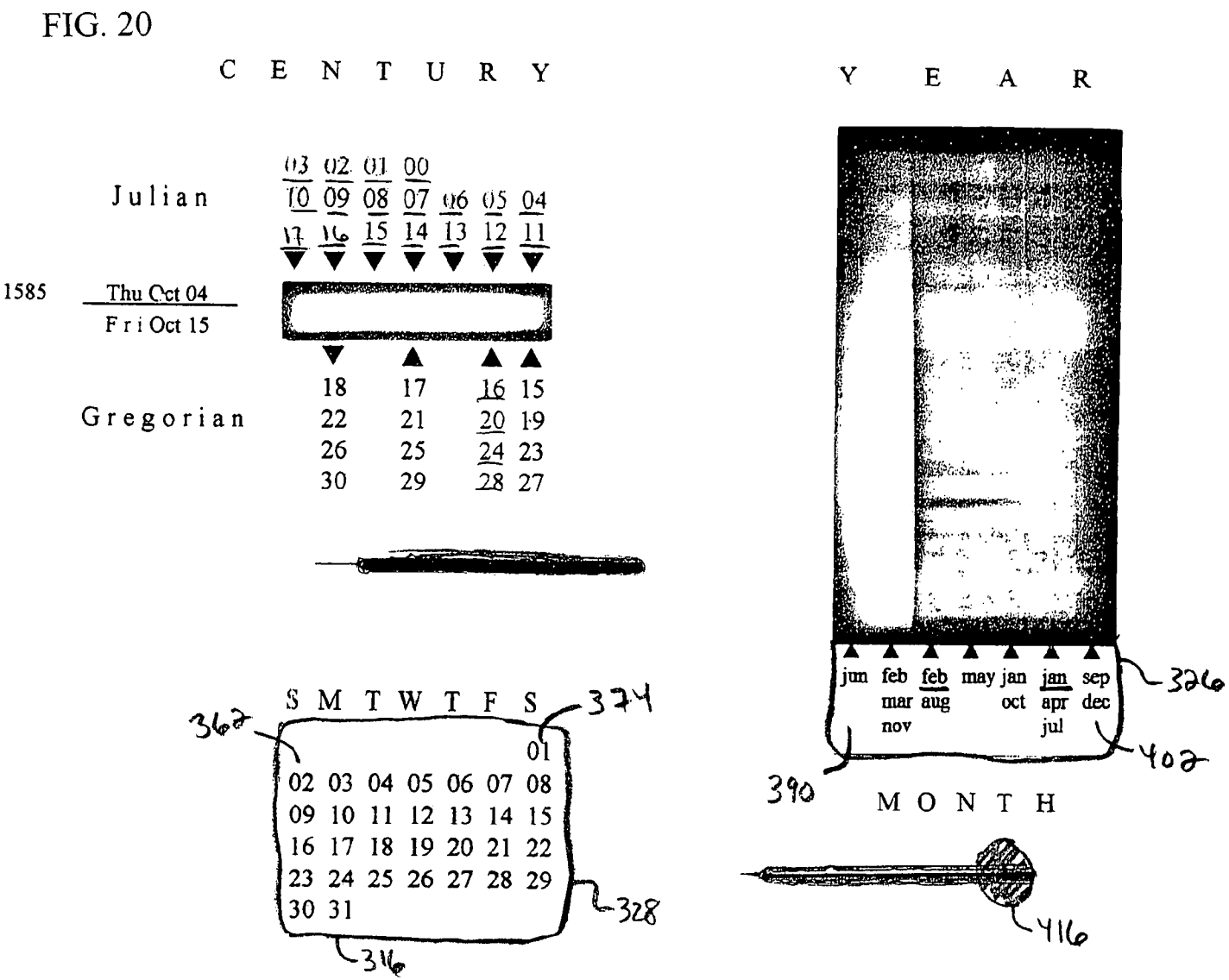
FIG. 20 shows the calendar system of FIG. 4 having the month/date tables in a seventh position.

When the month table 326 is in a seventh position, as seen in FIG. 20, the first column visible in the date window 316 is column 362, and the last column visible in the window is column 374.

It is also noted that the invention in its various embodiments can include handles such as those seen FIG. 4 (reference numbers 124 and 416). However, as is evident in the embodiment shown in FIG. 1, the device can also work without handles (e.g. the user would simply slide the two pieces 133 (FIG. 2), 158 (FIG. 3) into the desired position using the stickiness of his or her fingers).

Figure 21:
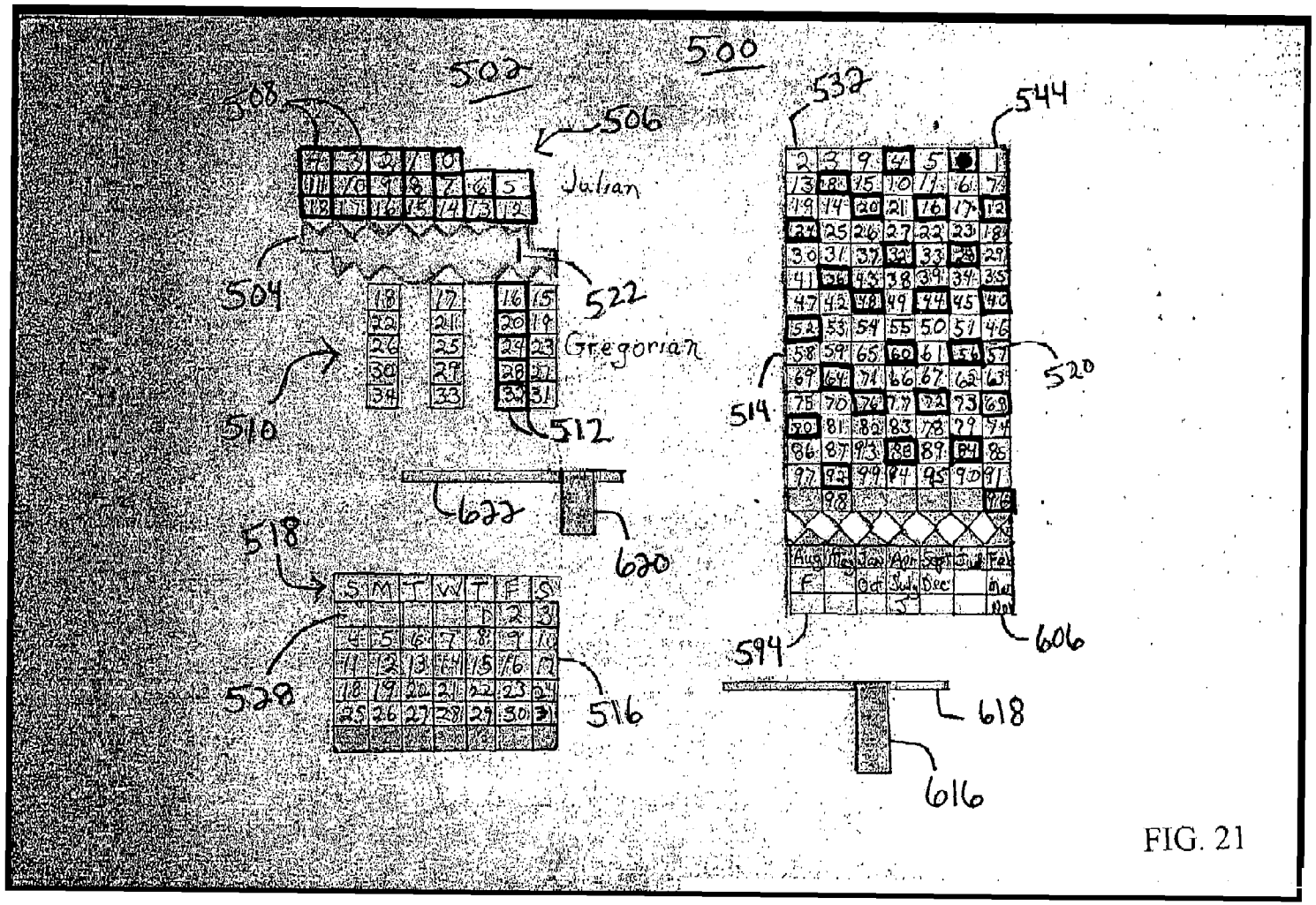
FIG. 21 shows a perpetual calendar system according to another embodiment of the present invention.
Figure 22:
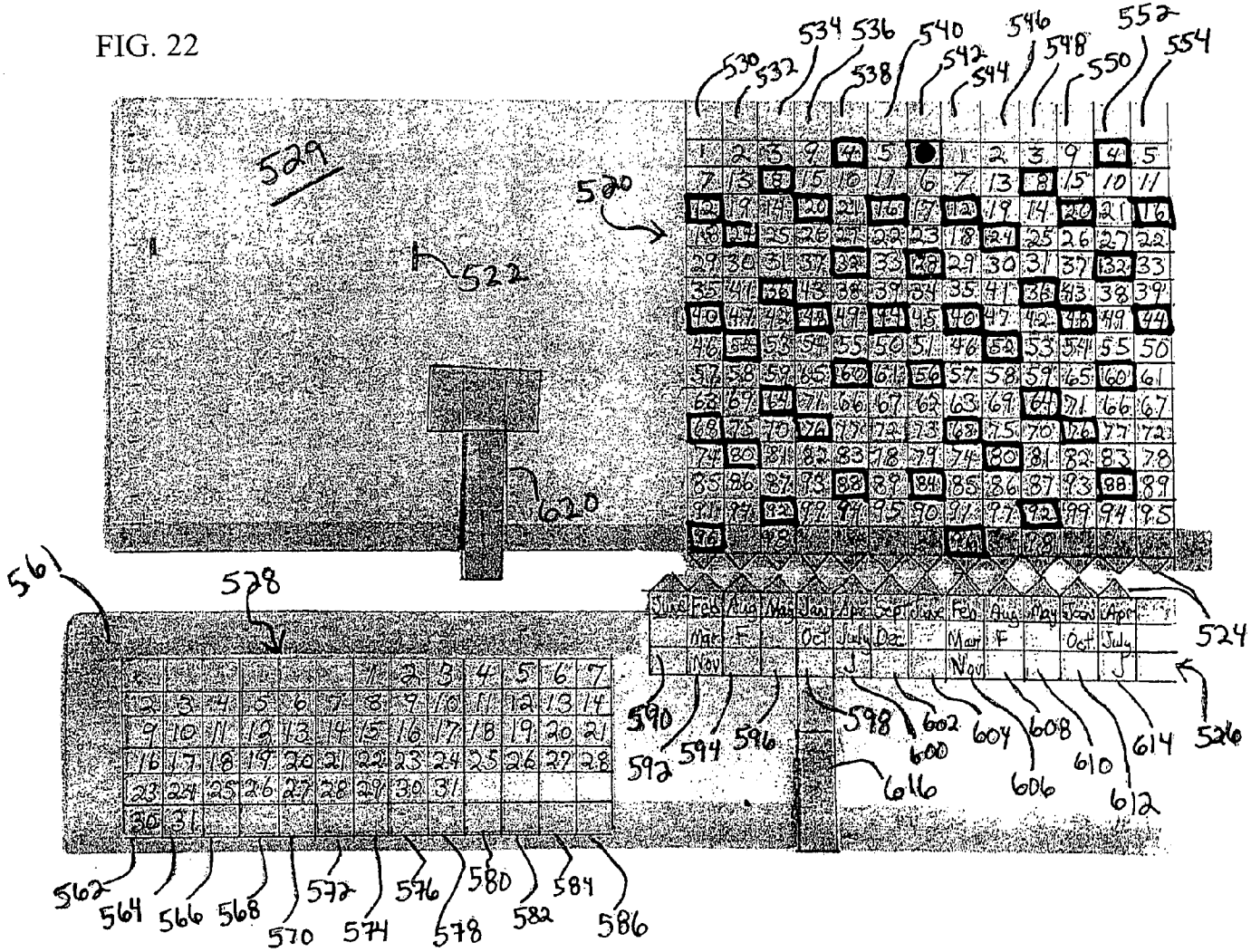
FIG. 22 shows a year table piece and a month/date table piece corresponding to the calendar system of FIG. 21 according to one embodiment of the present invention.

FIGS. 21 and 22 show yet another embodiment of the present invention. This particular embodiment also includes both Julian and Gregorian century tables. This system 500 includes a user interface 502 that includes a first window (or century indicator window) 504, a Julian century table 506 that has various columns 508. It also includes a Gregorian table 510, likewise having a variety of columns 512. The interface 502 includes a second window (or year window) 514, and a third window (date window) 516. As with the embodiment previously discussed, the system also includes a weekday table 518, a year table 520, and a century indicator 522. Alignment indicators 524 are also included to help a user more precisely line up month and year data.

A month table 526 and a date table 528 are also featured in this embodiment.

This embodiment further includes a handle or lever 620 that extends through slot or lever channel 622, and a second lever or handle 616 that extends through lever channel or slot 618.

FIG. 22 shows a year table piece 529 corresponding to the calendar system of FIG. 21, according to one embodiment of the present invention. In this piece 529, the year table 520 includes columns 530, 532, 534, 536, 538, 540, 542, 544, 546, 548, 550, 552, 554. Seven of these columns 532, 534, 536, 538, 540, 542, 544 are visible in the window 514 shown in FIG. 21.

The year table piece 529 also includes the century indicator 522. Handle 620 is coupled to the piece 529, and extends up into the user interface 502 through lever channel 622 (FIG. 21).

FIG. 22 also shows a month/date table piece 561 corresponding to the calendar system of FIG. 21, according to one embodiment of the present invention. This piece 561 shows more fully the date table 528, which has thirteen columns 562, 564, 566, 568, 570, 572, 574, 576, 578, 580, 582, 584, 586. Also shown is the month table 526, which similarly has thirteen columns 590, 592, 594, 596, 598, 600, 602, 604, 606, 608, 610, 612, 614.

Handle 616 is coupled to piece 561 and extends up into the user interface 502 (FIG. 21) through channel 618. Similarly, handle 620 is coupled to piece 529 and extends up into the user interface through channel 622.

It has been noted that the present system accounts for leap years. In particular, as can be observed in FIGS. 2, 5 and 22, every year that is divisible by four is either underscored or boxed to signify a leap year. When the date being researched falls in January or February of a leap year, the underscored months are selected (as seen in FIGS. 3 and 6). In the Gregorian system, the years ending with 00 deserve special attention. In this system, only those years evenly divisible by 400 are leap years. Thus, 2000 is a leap year; 1900 and 2100 are not.

Illustrative Methods of Operation

It is to be noted that the first two digits of a year are used in this calendar system. They should not be confused with the name of the century. For example, the current, $21^{th}$ century started in January, 2001 and will end in December 2100. For the first 99 years of this century, the first two digits are 20. They become 21 only for the last ($100^{th}$) year of the $21^{st}$ century.

Using the embodiment shown in FIG. 23 as an example, the operation of one embodiment of the present device would be as follows:

A user wanting to know the day of the week on which a certain event took place would 1) identify the year, month, and date of the event;
2) align the century indicator 322 to the proper century in the appropriate century table 306, 310 (depending on the century in which the event took place);
3) locate the year in window 314;
4) then, adjust the month table 326 using the indicators 324 so that the appropriate month column aligns underneath the year;
5) locate the date in the date table to find the desired day of the week.

Figure 23:
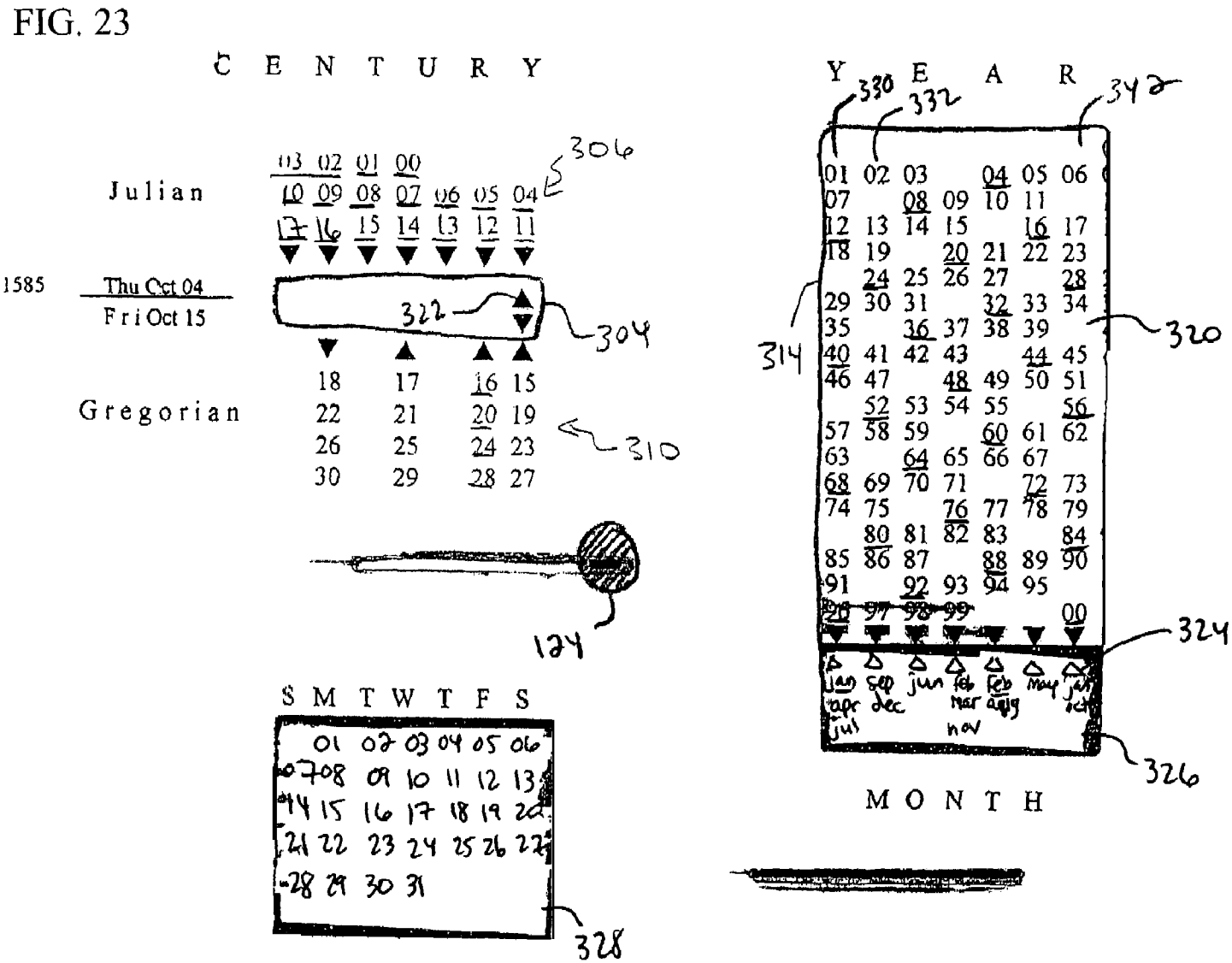
FIG. 23 shows the perpetual calendar system of FIG. 4 in one configuration.

Specifically, if the event was Pearl Harbor Day, Dec. 7, 1941, the user would:

1) align the century indicator 322 with 19 in the Gregorian century table 310 (see FIG. 23);
2) continuing in FIG. 23, find that 41 appears in column 332 of the year table 320:
3) adjust indicator 324 of the month table 326 to bring dec under column 332;
4) continuing in FIG. 23, the date table 328 shows that the seventh fell on a Sunday.

Yet another example of how the present system can operate is as follows (using FIGS. 24 and 25):

The text of the Mayflower Compact states that it was signed on " . . . the eleventh of November (New Style, November 21) . . . 1620." The term "New Style" refers to the Gregorian calendar system, which had been in use everywhere else for 38 years at that time.

Figure 24:
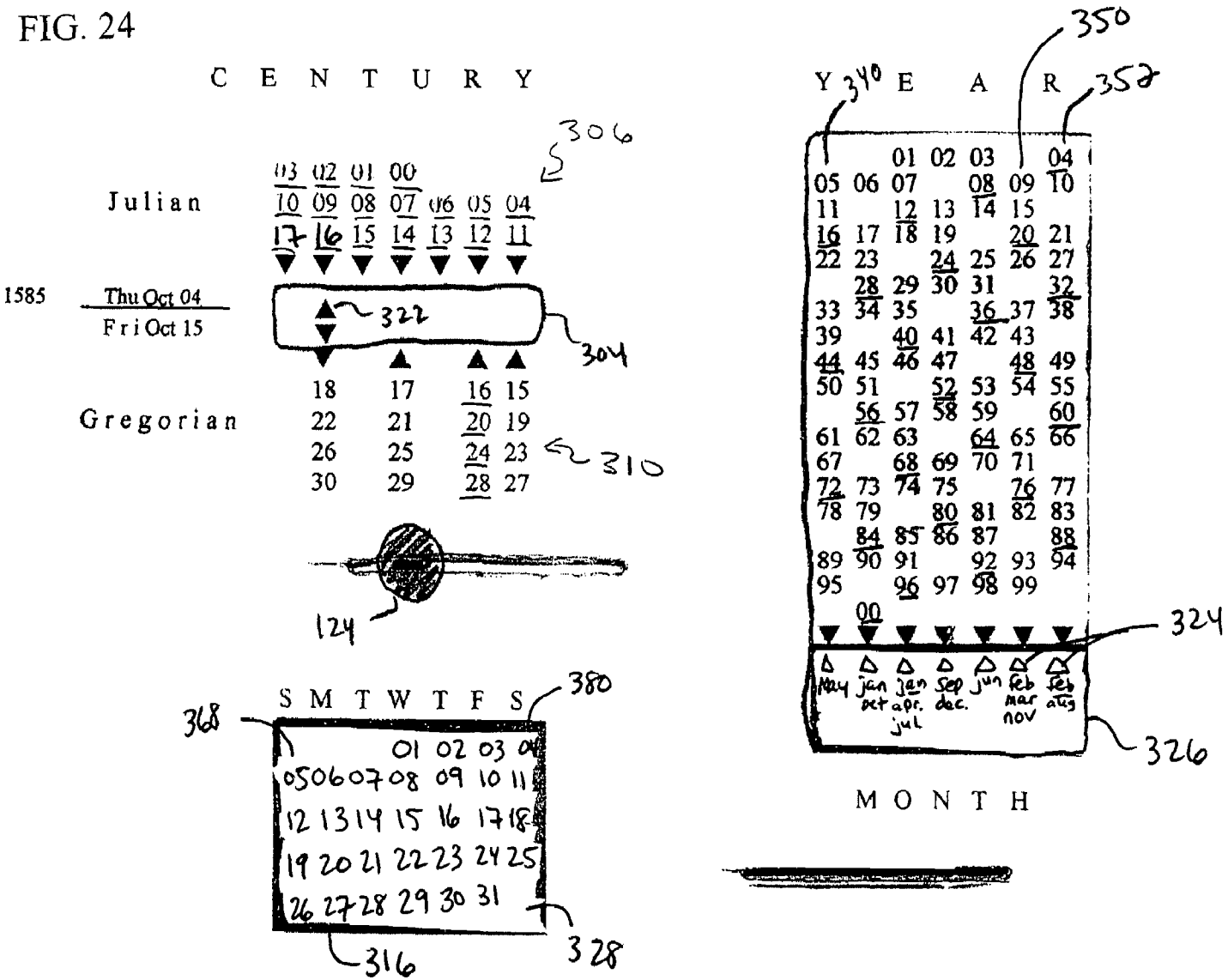
FIG. 24 shows the perpetual calendar system of FIG. 4 in yet another configuration.

If one wanted to verify that both 11 Nov. 1620 in the Julian system and 21 Nov. 1620 in the Gregorian system refer to the same day of the week, he or she could use the present system in the following manner:

To determine the day of the week for Julian Nov. 11, 1620:

1) align the century indicator 322 with 16 in the Julian century table 310 (see FIG. 24);

2) continuing in FIG. 24, find that 20 appears in column 350;

3) adjust indicator 324 of the month table 326 to bring 'nov' over such that it aligns with the indicator 324 of column 350;

4) continuing in FIG. 24, the date table 328 shows that the eleventh was a Saturday.

Figure 25:
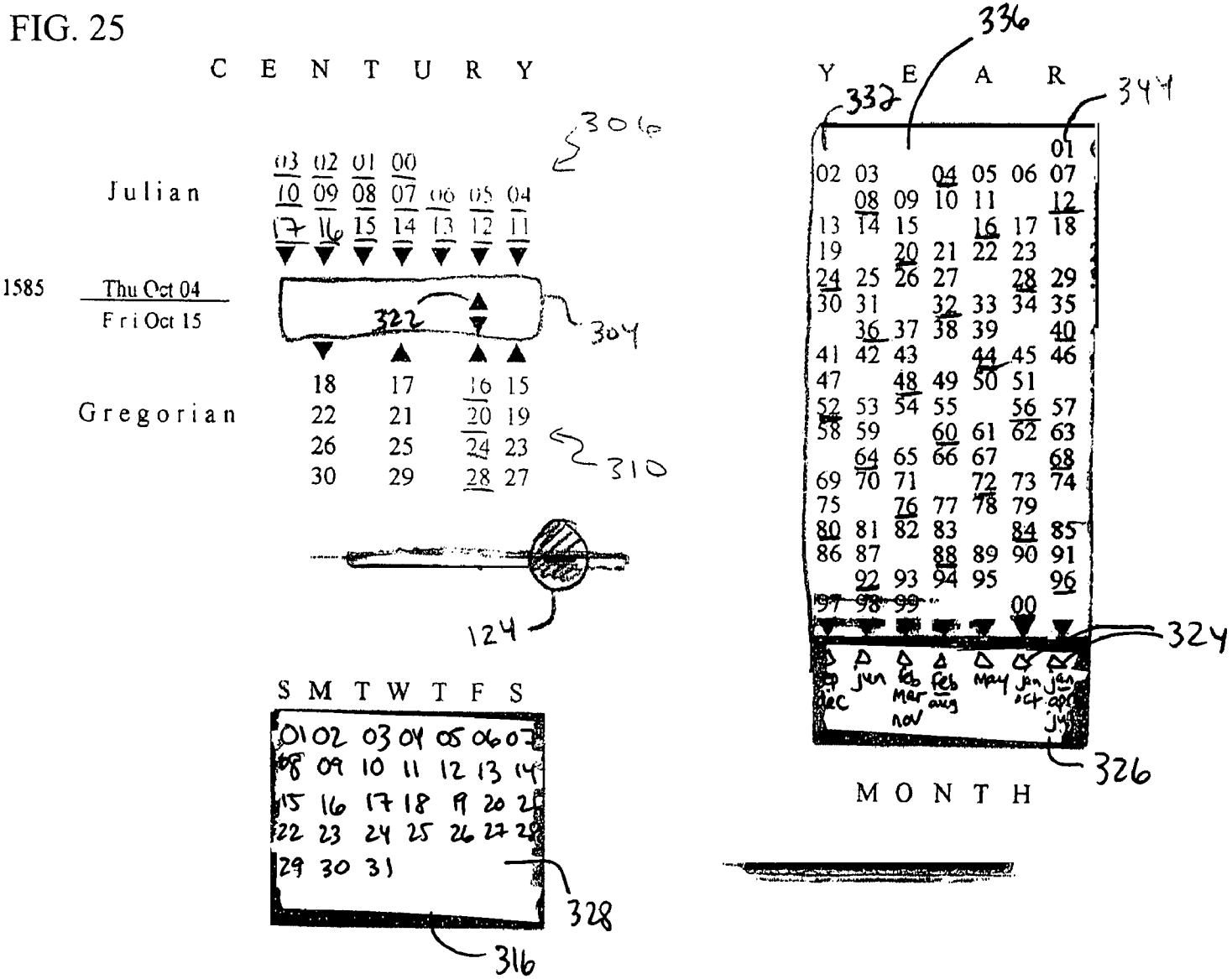
FIG. 25 shows the perpetual calendar system of FIG. 4 in yet another configuration.

To determine the day of the week for Gregorian Nov. 21, 1620;

1) align the century indicator 322 with 16 in the Gregorian century table 310 (see FIG. 25);

2) continuing in FIG. 25, find that 20 appears in column 336;

3) adjust indicator 324 of the month table to bring 'nov' over to column 336;

4) continuing in FIG. 25, the date table 328 shows that the 21$^{st}$ was a Saturday.

Variations of the Present Invention

It is understood that the above-described embodiments are only illustrative of the application of the basic principles of the present invention. Numerous modifications and alternative arrangements may be devised by those skilled in the art without departing from the spirit and scope of the present invention.

The horizontal relation between the contents of the various columns displayed in the first and second windows is important as it produces the correct display in the third window. However, in such embodiments, the vertical relations between the different components may be changed without effect.

In another embodiment, the device could be cylindrical in shape. The cylindrical version could then be the 'desktop version'. In such an embodiment, the month/date table piece could be rolled such that it serves as a stand. The cylindrical user interface would fit over the month/date table piece and rotate around it. The century/year table piece would fit into the top of the cylindrical user interface to rest on top of the lower slider. Washers could be placed between cylinders to make sure they rotate independently. The century/year table piece could then be rotated from the top, inside the user interface, to select a century and locate the desired year column. The user interface (with the century/year table piece) would then be turned while holding onto the base (and thus the month/date table piece) to move a month into the column having the selected year. Such an embodiment could be further modified without difficulty to become a novel pencil-holder.

What is claimed is:

1. A calendar system comprising:

a) a user interface having:
   i) a first window, including a century table associated therewith;
   ii) a second window; and
   iii) a third window including a weekday table associated therewith;
b) a year table piece, having a century indicator that is movably displayed in the first window; and a year table, seven columns of which are movably displayed in the second window;
c) a month/date table piece, having a date table, seven columns of which are movably displayed in the third window; and a month table, seven columns of which are also movably displayed in the second window;
d) a first lever coupled to the year table piece through a first lever channel in the user interface; and
e) a second lever coupled to the month/date table piece through a second lever channel in the user interface.

2. The system of claim 1, said year table comprising at least seven year columns.

3. The system of claim 1, said date table comprising at least seven date columns.

4. The system of claim 1, said month table comprising at least seven month columns.

5. The system of claim 1, said century table comprising at least two century columns.

6. A calendar system comprising:

a) a user interface having:
   i) a century table;
   ii) a weekday table;
   iii) a first lever channel; and
   iv) a second lever channel;
b) a first window in the user interface substantially adjacent to the century table;
c) a second window in the user interface;
d) a third window in the user interface substantially adjacent to the weekday table;
e) a year table piece, having a century indicator that is movably displayed in the first window; and a year table, seven columns of which are movably displayed in the second window;
f) a month/date table piece, having a date table, seven columns of which are movably displayed in the third window; and a month table, seven columns of which are also movably displayed in the second window;
g) a first lever coupled to the year table piece through a first lever channel in the user interface; and
h) a second lever coupled to the month/date table piece through a second lever channel in the user interface.

7. The system of claim 6, said year table comprising at least seven year columns.

8. The system of claim 6, said date table comprising at least seven date columns.

9. The system of claim 6, said month table comprising at least seven month columns.

10. The system of claim 6, said century table comprising at least two century columns.

11. A method for identifying which weekday a selected date falls upon, comprising the steps of:

a) providing a calendar system, comprising a user interface having:

i) a century table; a weekday table; a first lever channel; and a second lever channel;

ii) a first window in the user interface substantially adjacent to the century table;

iii) a second window in the user interface;

iv) a third window in the user interface substantially adjacent to the weekday table;

v) a year table piece, having a century indicator that is movably displayed in the first window; and a year table, seven columns of which are movably displayed in the second window;

vi) a month/date table piece, having a date table, seven columns of which are movably displayed in the third window; and a month table, seven columns of which are also movably displayed in the second window;

vii) a first lever coupled to the year table piece through a first lever channel in the user interface; and viii) a second lever coupled to the month/date table piece through a second lever channel in the user interface;

b) identifying a desired century and aligning the century indicator with the desired century in the century table;

c) identifying a desired year;

d) identifying a desired month and aligning the desired month with the desired year month; and e) identifying a desired day, and observing which weekday is aligned with the day; whereby the weekday upon which the selected date falls is identified.

12. The system of claim 11, said year table comprising at least seven year columns.

13. The system of claim 11, said date table comprising at least seven date columns.

14. The system of claim 11, said month table comprising at least seven month columns.

15. The system of claim 11, said century table comprising at least two century columns.

* * * * *